US010327078B2

(12) United States Patent
Pedersen et al.

(10) Patent No.: US 10,327,078 B2
(45) Date of Patent: Jun. 18, 2019

(54) HEARING AID COMPRISING A DIRECTIONAL MICROPHONE SYSTEM

(71) Applicant: Oticon A/S, Smørum (DK)

(72) Inventors: Michael Syskind Pedersen, Smørum (DK); Andreas Thelander Bertelsen, Smørum (DK)

(73) Assignee: Oticon A/S, Smørum (DK)

( * ) Notice: Subject to any disclaimer, the term of this patent is extended or adjusted under 35 U.S.C. 154(b) by 105 days.

(21) Appl. No.: 15/482,006

(22) Filed: Apr. 7, 2017

(65) Prior Publication Data

US 2017/0295436 A1 Oct. 12, 2017

(30) Foreign Application Priority Data

Apr. 8, 2016 (EP) ..... 16164350

(51) Int. Cl.
*H04R 25/00* (2006.01)

(52) U.S. Cl.
CPC ..... *H04R 25/407* (2013.01); *H04R 25/405* (2013.01); *H04R 25/505* (2013.01); (Continued)

(58) Field of Classification Search
CPC .... H04R 3/005; H04R 25/405; H04R 25/407; H04R 25/505; H04R 25/552; (Continued)

(56) References Cited

U.S. PATENT DOCUMENTS 7,313,241 B2 * 12/2007 Hamacher ..... H04R 25/70 381/312
2004/0136541 A1 7/2004 Hamacher et al.
(Continued)

FOREIGN PATENT DOCUMENTS

EP 1 414 268 A2 4/2004
EP 1 414 268 A3 12/2010
EP 2 993 915 A1 3/2016

*Primary Examiner* — Brian Ensey
(74) *Attorney, Agent, or Firm* — Birch, Stewart, Kolasch & Birch, LLP

(57) ABSTRACT

A hearing aid comprises a BTE-part adapted for being located behind an ear (ear) of a user, and comprising a) a multitude M of microphones, which—when located behind the ear of the user—are characterized by respective transfer functions, $H_{BTEi}(\theta, \varphi, r, k)$, representative of propagation of sound from sound sources S to the respective microphones b) a memory unit comprising complex, frequency dependent constants $W_i(k)'$, i=1, . . . , M, c) a beamformer filtering unit for providing a beamformed signal Y as a weighted combination of the microphone signals using said complex, frequency dependent constants The frequency dependent constants are determined to provide a resulting transfer function $$H_{pinna}(\theta,\varphi,r,k)=\Sigma_{i=1}^{M}W_i(k)\cdot H_{BTEi}(\theta,\varphi,r,k),$$

so that a difference between the resulting transfer function $H_{pinna}(\theta, \varphi, r, k)$ and a transfer function $H_{ITE}(\theta, \varphi, r, k)$ of a microphone located close to or in the ear canal fulfills a predefined criterion.

20 Claims, 11 Drawing Sheets
(1 of 11 Drawing Sheet(s) Filed in Color)

(52) U.S. Cl.
CPC ..... *H04R 25/70* (2013.01); *H04R 25/558* (2013.01); *H04R 2225/021* (2013.01); *H04R 2225/025* (2013.01); *H04R 2225/43* (2013.01)

(58) Field of Classification Search
CPC ..... H04R 25/554; H04R 2225/43; H04R 2225/50; H04R 2225/51
See application file for complete search history.

(56) References Cited

U.S. PATENT DOCUMENTS

| | | | | |
|---|---|---|---|---|
| 2005/0175204 | A1 | 8/2005 | Bock | |
| 2014/0270219 | A1* | 9/2014 | Yu | H04R 3/005 381/71.1 |

* cited by examiner

HEARING AID COMPRISING A DIRECTIONAL MICROPHONE SYSTEM

SUMMARY

The present disclosure deals with hearing aids, in particular with spatial filtering of sound impinging on microphones of the hearing aid. An ideal location for a microphone aiming at picking up sound for presentation to a hearing impaired user is in or at the ear canal of the user to take advantage of the acoustic properties of the outer ear (pinna and ear canal). Wearing a hearing instrument such as a behind-the-ear (BTE) instrument will affect the ability to localize sounds as the spatial properties of a sound processed by a hearing instrument is different from the spatial properties of a sound impinging at the eardrum. The spatial differences is mainly due to the placement of the microphones away from the ear canal, e.g. behind the ear.

In a hearing aid where the sound signal is picked up by microphones located in a BTE-part behind an ear of a user, the microphones will have a (typically un-intended) tendency to (over-) emphasize signals from behind the user compared to signals from a frontal direction (due to the shadowing effect of the head and ears of the user). The present disclosure provides a scheme for compensating an inherent preference to signals from other directions than a target direction (e.g. the front) in a hearing aid comprising microphones NOT located at ideal positions at or in the ear canal.

Typically hearing instruments contain two microphones. By combining the different microphones with different filtering, it is possible to modify the directional response of the microphones. Hereby the directional pattern can be optimized towards a directional pattern closer to the directional response at the ideal microphone position.

The microphone location effect (MLE) generally describes attempts to take into account the fact that the response towards the target direction does not necessarily correspond to an ideal microphone placement near the eardrum. Especially when a beamformer is constrained, with a distortionless response towards the target direction, an adjustment of the target response may be necessary. Further, the MLE may correspond to the look direction, which could be adapted, if the target direction is allowed to change over time. In that case, the MLE should change in a similar way at the two instruments. MLE-compensation provides a frequency shaping in order to take into account that sound impinging from the target direction is not correct due to the incorrect microphone placement. The MLE, however only corrects the frequency response from the target direction. The pinna beamformer according to the present disclosure aims at correcting the directional response from all other directions, and as the target sound in the present implementation may be constrained to be as if it was recorded at the front microphone, the MLE from the target direction perfectly complements the pinna beamformer.

A Hearing Aid:

In an aspect of the present application, a hearing aid comprising a part, termed a BTE-part (BTE), adapted for being located in an operational position at of behind an ear of a user is provided. The BTE-part comprises

- a multitude M of microphones ($M_{BTEi}$ i=1, . . . , M) for converting an input sound to respective electric input signals ($IN_i$, i=1, . . . , M), the multitude of microphones of the BTE-part, when located behind the ear of the user being characterized by transfer functions $H_{BTEi}(\theta, \varphi, r, k)$, i=1, . . . , M, representative of propagation of sound from sound sources S located at (θ, φ, r) around the hearing aid to the respective microphones ($M_{BTEi}$, i=1, . . . , M), when the BTE-part is located at its operational position, (θ, φ, r) representing spatial coordinates and k is a frequency index,
- a memory unit comprising complex, frequency dependent constants $W_i(k)'$, i=1, . . . , M,
- a beamformer filtering unit (BFU) for providing a beamformed signal Y as a weighted combination of said multitude of electric input signals using said complex, frequency dependent constants $W_i(k)'$, i=1, . . . , M, and $W_2(k)'$: $Y(k)=W_i(k)'\cdot IN_1+ \ldots +W_M(k)'\cdot IN_M$, and wherein said frequency dependent constants $W_i(k)'$, i=1, . . . , M, are determined to provide a resulting transfer function $$H_{pinna}(\theta,\varphi,r,k)=\Sigma_{i=1}^{M}W_i(k)\cdot H_{BTEi}(\theta,\varphi,r,k),$$

so that a difference between the resulting transfer function $H_{pinna}(\theta, \varphi, r, k)$ and a transfer function $H_{ITE}(\theta, \varphi, r, k)$ of a microphone located close to or in the ear canal (ITE) fulfils a predefined criterion.

Thereby an improved hearing aid may be provided.

In an embodiment, the BTE-part has two (first and second) microphones (M=2). The BTE-part comprises first and second microphones for converting an input sound to first and second electric input signals ($IN_1$, $IN_2$), respectively, the first and second microphones of the BTE-part, when located behind the ear of the user, being characterized by transfer functions $H_{BTE1}(\theta, \varphi, r, k)$ and $H_{BTE2}(\theta, \varphi, r, k)$ representative of propagation of sound from sound sources S located at (θ, φ, r) around the hearing aid to the first and second microphones, when the BTE-part is located at its operational position, (θ, φ, r) representing spatial coordinates and k is a frequency index,

- a memory unit comprising complex, frequency dependent constants $W_1(k)$ and $W_2(k)$,
- a beamformer filtering unit for providing a beamformed signal Y as a weighted combination of said first and second electric input signals using said complex, frequency dependent constants $W_1(k)$ and $W_2(k)$: $Y(k)=W_1(k)\cdot IN_1+W_2(k)\cdot IN_2$.

The frequency dependent constants $W_1(k)$ and $W_2(k)$ are determined to provide a resulting transfer function $$H_{pinna}(\theta,\varphi,r,k)=W_1(k)\cdot H_{BTE1}(\theta,\varphi,r,k)+W_2(k)\cdot H_{BTE2}(\theta,\varphi,r,k),$$

so that a difference between the resulting transfer function $H_{pinna}(\theta, \varphi, r, k)$ and a transfer function $H_{ITE}(\theta, \varphi, r, k)$ of a microphone located close to or in the ear canal (ITE) fulfils a predefined criterion.

The above solution is described in a time-frequency domain. The solution may alternatively be described in the time domain. In an aspect, a hearing aid comprising a part, termed a BTE-part, adapted for being located behind an ear of a user is provided. The BTE-part comprises

- a multitude of microphones ($M_{BTEi}$, i=1, . . . , M) for converting an input sound to respective electric input signals ($IN_i$, i=1, . . . , M), the multitude of microphones of the BTE-part, when located behind the ear of the user being characterized by impulse responses $h_{BTEi}(\theta, \varphi, r)$, i=1, . . . , M, representative of propagation of sound from sound sources S located at (θ, φ, r) around the hearing aid to the respective microphones ($M_{BTEi}$, i=1, . . . , M), when the BTE-part is located at its operational position, (θ, φ, r) representing spatial coordinates,
- a memory unit comprising sets of filter coefficients $w_i$, i=1, . . . , M, a beamformer filtering unit for providing a beamformed signal Y as a sum of filtered electric input signals using said filter coefficients $w_i$, i=1, . . . , M, representing respective filters applied to the multitude of electric input signals ($IN_i$): $Y=w_1*IN_1+ \ldots w_M*IN_M$, where * denotes the convolution operator.

The filter coefficients $w_i$, i=1, . . . , M, are determined to provide a resulting impulse response $$h_{pinna}(\theta,\varphi,r)=\Sigma_{i=1}^{M} w_i h_{BTEi}(\theta,\varphi,r),$$

so that a difference between the resulting impulse response $h_{pinna}(\theta, \varphi, r)$ and an impulse response $h_{ITE}(\theta, \varphi, r)$ of a microphone located close to or in the ear canal (ITE) fulfils a predefined criterion.

The spatial coordinates (θ, φ, r) represent coordinates of a spherical coordinate system, θ, φ, r, representing polar angle, azimuthal angle and radial distance, respectively (cf. e.g. FIG. 1A).

The first and second microphones need not be located in a BTE-part but may generally be located at any non-ideal position (i.e. other than at or in an ear canal), as long as the hearing aid is configured to allow mounting of first and second microphones at fixed, predefined positions at the ear of the user in a reproducible way (which is substantially constant during wear of the hearing aid). Further, the hearing aid may comprise more than two microphones, such as three or more, either located in the BTE-part or in other parts of the hearing aid, preferably having a substantially fixed spatial location relative to each other, when the hearing aid is mounted in an operational condition on the user.

In an embodiment, the predefined criterion comprises a minimization of a difference or distance measure between the resulting transfer function $H_{pinna}(\theta, \varphi, r, k)$ and the transfer function $H_{ITE}(\theta, \varphi, r, k)$ of the microphone located close to or in the ear canal (or equivalently between impulse responses $h_{pinna}(\theta, r)$ and $h_{ITE}(\theta, \varphi, r)$).

In an embodiment, the hearing aid comprises a hearing instrument, a headset, an earphone, an ear protection device or a combination thereof.

In an embodiment, the hearing aid comprises an output unit (e.g. a loudspeaker, or a vibrator or electrodes of a cochlear implant) for providing output stimuli perceivable by the user as sound. In case a vibrator is used as output transducer, cross talk between the ears may appear. Such cross-talk may be taken into consideration when optimizing the beam pattern. In an embodiment, the hearing aid comprises a forward or signal path between the first and second microphones and the output unit. The beamformer filtering unit is located in the forward path. In an embodiment, a signal processing unit is located in the forward path. In an embodiment, the signal processing unit is adapted to provide a level and frequency dependent gain according to a user's particular needs. In an embodiment, the hearing aid comprises an analysis path comprising functional components for analyzing the electric input signal(s) (e.g. determining a level, a modulation, a type of signal, an acoustic feedback estimate, etc.). In an embodiment, some or all signal processing of the analysis path and/or the forward path is conducted in the frequency domain. In an embodiment, some or all signal processing of the analysis path and/or the forward path is conducted in the time domain.

In an embodiment, an analogue electric signal representing an acoustic signal is converted to a digital audio signal in an analogue-to-digital (AD) conversion process, where the analogue signal is sampled with a predefined sampling frequency or rate $f_s$, $f_s$ being e.g. in the range from 8 kHz to 48 kHz (adapted to the particular needs of the application) to provide digital samples $x_n$ (or x[n]) at discrete points in time $t_n$ (or n), each audio sample representing the value of the acoustic signal at $t_n$ by a predefined number $N_s$ of bits, N, being e.g. in the range from 1 to 16 bits. A digital sample x has a length in time of $1/f_s$, e.g. 50 μs, for $f_s$=20 kHz. In an embodiment, a number of audio samples are arranged in a time frame. In an embodiment, a time frame comprises 64 or 128 audio data samples. Other frame lengths may be used depending on the practical application.

In an embodiment, the hearing aids comprise an analogue-to-digital (AD) converter to digitize an analogue input with a predefined sampling rate, e.g. 20 kHz. In an embodiment, the hearing aids comprise a digital-to-analogue (DA) converter to convert a digital signal to an analogue output signal, e.g. for being presented to a user via an output transducer.

In an embodiment, the hearing aid, e.g. the first and second microphones each comprises a (TF-)conversion unit for providing a time-frequency representation of an input signal. In an embodiment, the time-frequency representation comprises an array or map of corresponding complex or real values of the signal in question in a particular time and frequency range. In an embodiment, the TF conversion unit comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the frequency domain. In an embodiment, the frequency range considered by the hearing aid from a minimum frequency $f_{min}$ to a maximum frequency $f_{max}$ comprises a part of the typical human audible frequency range from 20 Hz to 20 kHz, e.g. a part of the range from 20 Hz to 12 kHz. In an embodiment, a signal of the forward and/or analysis path of the hearing aid is split into a number NI of frequency bands, where NI is e.g. larger than 5, such as larger than 10, such as larger than 50, such as larger than 100, such as larger than 500, at least some of which are processed individually. In an embodiment, the hearing aid is/are adapted to process a signal of the forward and/or analysis path in a number NP of different frequency channels (NP≤NI). The frequency channels may be uniform or non-uniform in width (e.g. increasing in width with frequency), overlapping or non-overlapping. Each frequency channel comprises one or more frequency bands.

In an embodiment, the hearing aid comprises a hearing instrument, e.g. a hearing instrument adapted for being located at the ear or fully or partially in the ear canal of a user, or for being fully or partially implanted in the head of the user.

Use:

In an aspect, use of a hearing aid as described above, in the 'detailed description of embodiments' and in the claims, is moreover provided. In an embodiment, use is provided in a system comprising one or more hearing instruments, headsets, ear phones, active ear protection systems, etc., e.g. in handsfree telephone systems, teleconferencing systems, public address systems, karaoke systems, classroom amplification systems, etc.

A Method:

In an aspect, a method of determining a multitude M of complex, frequency dependent constants $W_i(k)'$, i=1, . . . , M, representing an optimized fixed beam pattern of a fixed beamformer filtering unit providing a beamformed signal as a weighted combination of said multitude of electric input signals $IN_i$, i=1, . . . , M, to the beamformer filtering unit, where $IN_i$ are electric input signals provided by a multitude of microphones ($M_{BTEi}$, i=1, . . . , M) of a hearing aid is furthermore provided. The BTE-part is adapted for being located at or behind an ear of a user. The method comprises Determining respective transfer functions $H_{BTEi}(\theta, \varphi, r, k)$ and $H_{ITE}(\theta, \varphi, r, k)$ from sound sources S located at spatial coordinates (θ, φ, r) around the hearing aid to the multitude of microphones ($M_{BTEi}$, i=1, . . . , M), and to a microphone located close to or in the ear canal (ITE), (θ, φ, r) representing spatial coordinates and k being a frequency index, and Determining said frequency dependent constants $W_i(k)'$, i=1, . . . , M, to provide a resulting transfer function $$H_{pinna}(\theta,\varphi,r,k)=\Sigma_{i=1}^{M}W_i(k)\cdot H_{BTEi}(\theta,\varphi,r,k),$$

so that a difference between the resulting transfer function $H_{pinna}(\theta, \varphi, r, k)$ and the transfer function $G_{ITE}(\theta, \varphi, r, k)$ of a microphone located close to or in the ear canal (ITE) fulfils a predefined criterion.

It is intended that some or all of the structural features of the hearing aid described above, in the 'detailed description of embodiments' or in the claims can be combined with embodiments of the method, when appropriately substituted by a corresponding process and vice versa. Embodiments of the method have the same advantages as the corresponding devices.

The above method is expressed in the time-frequency domain but may likewise be executed in the time domain.

In an embodiment, the spatial coordinates (θ, φ, r) represent coordinates of a spherical coordinate system, θ, φ, r, representing polar angle, azimuthal angle and radial distance, respectively (cf. e.g. FIG. 1A). In an embodiment, the spherical coordinate system has its origo (0, 0, 0) at the location of one of the (BTE-)microphones of the BTE-part, or between the first and second BTE-microphones of the BTE-part. Other definitions could of course be chosen, e.g. to define the center of the head as the center (in between the two ears), whereby it can be avoided that the angle defined at one ear is different from an angle defined at the other ear. In an embodiment, the transfer functions or impulse responses, $H_x$, $h_x$, (x=BTE1, BTE2, ITE), respectively, are only determined in a polar plane (e.g. φ=90°, or z=0, cf. e.g. FIG. 1A), providing functions $H_x(\theta,r)$, $h_x(\theta, r)$, and optionally only at one radial distance or range of distances, e.g. $r_0$=3-5 m, or a distance $r_\infty$ corresponding to the acoustic far field, providing functions $H_x(\theta)$, $h_x(\theta)$.

In an embodiment, the transfer functions $H_x(\theta, \varphi, r, k)$ or impulse responses $h_x(\theta, \varphi, r)$ are determined by measurement. The received sound signal from a (point) sound source (a time domain signal) at microphone locations corresponding to the locations on a hearing aid BTE-part (cf. e.g. BTE-microphones ($M_{BTE1}$, $M_{BTE2}$) in FIG. 2A) when worn by user (or by a model of the user) in an operational location at or behind an ear is measured at different spatial locations. In an embodiment, a sound pressure level at the location of the microphone in question is measured (e.g. by a sound pressure level sensor, such as a microphone). The same measurement is performed using a microphone $M_{ITE}$ (cf. e.g. (ITE (test) microphone) in FIG. 2A) located at or in the ear canal (e.g. a test microphone). In an embodiment, the hearing aid comprises a (ITE) microphone located at or in an ear canal of the user. In an embodiment, the microphones of the hearing aid are used to measure the sound pressure levels from a given sound source over spatial coordinates (θ, φ, r). Measurements are e.g. made for the three microphone locations (of $M_{BTE1}$, $M_{BTE2}$, $M_{ITE}$) with a sound source placed at a number of different spatial locations around a user (or a model of a user), e.g. at all locations relative to the user expected to be of interest. The number and distribution of the different spatial locations around the user may be chosen according to the application in question (e.g. depending on the intended accuracy of the resulting pinna beamformer (beamformed signal Y), the directions/distances from user to sound source expected to be the most relevant, etc.). The measurements may preferably be conducted in an acoustic laboratory, e.g. a low reflection, e.g. anechoic, room. In an embodiment, the measurements are performed during a fitting session, where the hearing aid(s) is/are adapted to a particular user. In an embodiment, the measurements are performed using a model of a human head and the same transfer functions/impulse responses are used for a number of persons. In an embodiment, the measurements are performed in a sound studio with a head-and-torso-simulator (HATS, Head and Torso Simulator 4128C from Brüel & Kjær Sound & Vibration Measurement A/S)).

In an embodiment, only the $h_{ITE}$ response is measured in advance, whereas the $H_{BTE1}$ and $H_{BTE2}$ are estimated while wearing the hearing instrument(s).

In an embodiment, different sets of $H_{BTE}$s are stored and selected during use based on the acoustic properties of the specific user, or based on the current position of the hearing instrument(s) at the ear(s) of the user (microphone tilt, e.g. determined from an accelerometer) of the head.

As an alternative, the transfer functions $H_x(\theta, \varphi, r, k)$ or impulse responses $h_x(\theta, \varphi, r)$ may be determined by numerical calculation using a computer model of the user's head (or of a typical head) exhibiting acoustic propagation and reflection/attenuation properties of a real human head.

In an embodiment, the predefined criterion comprises a minimization of a difference or distance measure between the resulting transfer function $H_{pinna}(\theta, \varphi, r, k)$ and the transfer function $H_{ITE}(\theta, \varphi, r, k)$ of the microphone located close to or in the ear canal.

In an embodiment, the predefined criterion comprises determining $W_i(k)$, i=1, . . . , M, to minimize a cost function comprising the resulting transfer function $H_{pinna}(\theta, \varphi, r, k)$ and the transfer function $H_{ITE}(\theta, \varphi, r, k)$ of a microphone located close to or in the ear canal (ITE).

In an embodiment, the predefined criterion comprises determining $W_i(k)'$, i=1, . . . , M, according to one of the following expressions:

$$\underset{W_i(k),\forall i}{\operatorname{argmin}}\left(\sum_{\theta,\varphi,r}\rho(\theta,\varphi,r,k)|\log|H_{pinna}(\theta,\varphi,r,k)|-\log|H_{ITE}(\theta,\varphi,r,k)||\right),$$

$$\underset{W_i(k),\forall i}{\operatorname{argmin}}\left(\sum_{\theta,\varphi,r}\rho(\theta,\varphi,r,k)(\log|H_{pinna}(\theta,\varphi,r,k)|-\log|H_{ITE}(\theta,\varphi,r,k)|)^2\right),$$

$$\underset{W_i(k),\forall i}{\operatorname{argmin}}\left(\sum_{\theta,\varphi,r}\rho(\theta,\varphi,r,k)||H_{pinna}(\theta,\varphi,r,k)|-|H_{ITE}(\theta,\varphi,r,k)||\right),$$

$$\underset{W_i(k),\forall i}{\operatorname{argmin}}\left(\sum_{\theta,\varphi,r}\rho(\theta,\varphi,r,k)||H_{pinna}(\theta,\varphi,r,k)|-|H_{ITE}(\theta,\varphi,r,k)||^2\right),$$

$$\underset{W_i(k),\forall i}{\operatorname{argmin}}\left(\sum_{\theta,\varphi,r}\rho(\theta,\varphi,r,k)(|H_{pinna}(\theta,\varphi,r,k)|^2-|H_{ITE}(\theta,\varphi,r,k)|^2)^2\right),$$

$$\underset{W_i(k),\forall i}{\operatorname{argmin}}\left(\sum_{\theta,\varphi,r}\rho(\theta,\varphi,r,k)||H_{pinna}(\theta,\varphi,r,k)|^2-|H_{ITE}(\theta,\varphi,r,k)|^2|\right),$$

where ρ(θ, φ, r, k) is a weighting function, and i=1, . . . , M is a microphone index.

In an embodiment, the number of microphones of the BTE-part M is 2 The above expressions also hold if the hearing aid contains more than two microphones (M≥2). The weighting function $\rho(\theta, \varphi, r, k)$ may be configured to compensate for the fact that some directions are more significant than other directions. In an embodiment, the weighting function $\rho(\theta, \varphi, r, k)$ is configured to emphasize spatial directions and/or frequency ranges that are expected to be of particular interest to the user, e.g. directions covering a frontal plane or a solid angle representing a subset thereof. Or, alternatively or additionally, $\rho(\theta, \varphi, r, k)$ may be configured to compensate for a non-uniform data collection. E.g., if only impulse responses in the horizontal plane are available, the data could be weighted by $\rho(\theta, \varphi, r, k)=|\sin(\theta)|$ in order to weight the data as if it was distributed on a sphere rather than on a circle. In an embodiment, p is independent of frequency k. In an embodiment p is equal to 1. In an embodiment, the weighting function $\rho(\theta, \varphi, r, k)$ is adaptively determined, e.g. in dependence of an acoustic environment (e.g. based on one or more detectors; e.g. including from one or more detectors of level, voice activity, direction of arrival, etc.). In an embodiment, the weighting function $\rho(\theta, \varphi, r, k)$ is configured to emphasize sound from a particular side relative to the user (e.g. in a car, of flight of other particular 'parallel seating configuration') or from the back of the user. In an embodiment, the weighting function $\rho(\theta, \varphi, r, k)$ is configured to adaptively determine a current direction to a sound source of possible interest to the user. In an embodiment, the hearing device comprises a user interface adapted to allow a user to qualify (e.g. accept or reject) such adaptive determination, cf. e.g. the 'Sound source weighting APP' described in connection with FIG. 10.

In an embodiment, the method is relates to a hearing aid comprising a BTE-part having two (first and second) microphones (M=2). The method is thus adapted to determine complex, frequency dependent constants $W_1(k)$ and $W_2(k)$ representing an optimized fixed beam pattern of a fixed beamformer filtering unit providing a beamformed signal Y as a weighted combination of first and second electric input signals $IN_1$ and $IN_2$, respectively, to the beamformer filtering unit. The first and second electric input signals $IN_1$ and $IN_2$ are provided by the first and second microphones, respectively. The BTE-part is adapted for being located at or behind an ear of a user. The method comprises Determining respective transfer functions $H_{BTE1}(\theta, \varphi, r, k)$, $H_{BTE2}(\theta, \varphi, r, k)$, and $H_{ITE}(\theta, \varphi, r, k)$ from sound sources S located at spatial coordinates $(\theta, \varphi, r)$ around the hearing aid (when worn by a user or by a model of the user) to the first and second microphones, and to a microphone located at or in the ear canal (ITE), $(\theta, \varphi, r)$ representing spatial coordinates and k being a frequency index, and Determining said frequency dependent constants $W_1(k)$ and $W_2(k)$ to provide a resulting transfer function $$H_{pinna}(\theta,\varphi,r,k)=W_1(k)\cdot H_{BTE1}(\theta,\varphi,r,k)+W_2(k)\cdot H_{BTE2}(\theta,\varphi,r,k),$$

so that a difference between the resulting transfer function $H_{pinna}(\theta, \varphi, r, k)$ and the transfer function $H_{ITE}(\theta, \varphi, r, k)$ of a microphone located close to or in the ear canal (ITE) fulfils a predefined criterion.

In an embodiment, the method comprises generating first and second fixed beamformers BF1 and BF2 as different weighted combinations of the first and second electric input signals $IN_1$ and $IN_2$, respectively, each beamformer being defined by frequency dependent complex weighting parameter sets $(W_{11}(k), W_{21}(k))$ and $(W_{12}(k), W_{22}(k))$, respectively, so that $$BF1(k)=W_{11}(k)\cdot IN_1+W_{21}(k)\cdot IN_2,$$

$$BF2(k)=W_{12}(k)\cdot IN_1+W_{22}(k)\cdot IN_2, \text{ and}$$

Generating the beamformed signal Y as a combination of said first and second fixed beamformers BF1 and BF2 according to the following expression $$Y(k)=BF1(k)-\beta(k)\cdot BF2(k),$$

where $\beta(k)$ is a frequency dependent parameter controlling the shape of the directional beam pattern of the beamformer filtering unit.

It should be noted that the sign in front of $\beta(k)$ might as well be +, if the signs of the weights are appropriately adapted.

In the present application, the intended meaning of subscripts p and q on complex weights $W_{pq}$ is that p refers to microphone (p=1, 2, . . . , M) and q to the beamformer (e.g. omni (o), target cancelling (c), etc.).

By insertion, the following expression for Y appears:

$$Y(k)=W_{11}(k)\cdot IN_1+W_{21}(k)\cdot IN_2-\beta(k)\cdot(W_{12}(k)\cdot IN_1+W_{22}(k)\cdot IN_2)$$

which can be rearranged to $$Y(k)=W_{11}(k)-\beta(k)\cdot W_{12}(k))\cdot IN_1+(W_{21}(k)-\beta(k)\cdot W_{22}(k))\cdot IN_2.$$

In other words $W_1=W_{11}(k)-\beta(k)\cdot W_{12}(k)$ and $W_2=W_{21}(k)-\beta(k)\cdot W_{22}(k)$.

This has the advantage that a single parameter $\beta$ (for each frequency band, k) can be used to optimize the predefined criterion.

In an embodiment, the predefined criterion comprises determining $W_1(k)$ and $W_2(k)$ by minimizing an expression for a distance measure between the beamformed signal $Y(\theta, \varphi, r, k)$ and the transfer function $H_{ITE}(\theta, \varphi, r, k)$ of a microphone located at or in the ear canal (ITE) with respect to the parameter $\beta(k)$.

In an embodiment, the predefined criterion comprises determining the parameter $\beta(k)$ (and thus $W_1(k)$ and $W_2(k)$) according to one of the following expressions:

$$\underset{\beta(k)}{\operatorname{argmin}}\left(\sum_{\theta,\varphi,r}\rho(\theta,\varphi,r,k)|\log|Y(\theta,\varphi,r,k,\beta)|-\log|H_{ITE}(\theta,\varphi,r,k)||\right),$$

$$\underset{\beta(k)}{\operatorname{argmin}}\left(\sum_{\theta,\varphi,r}\rho(\theta,\varphi,r,k)(\log|Y(\theta,\varphi,r,k,\beta)|-\log|H_{ITE}(\theta,\varphi,r,k)|)^2\right),$$

$$\underset{\beta(k)}{\operatorname{argmin}}\left(\sum_{\theta,\varphi,r}\rho(\theta,\varphi,r,k)||Y(\theta,\varphi,r,k,\beta)|-|H_{ITE}(\theta,\varphi,r,k)||\right),$$

$$\underset{\beta(k)}{\operatorname{argmin}}\left(\sum_{\theta,\varphi,r}\rho(\theta,\varphi,r,k)||Y(\theta,\varphi,r,k,\beta)|-|H_{ITE}(\theta,\varphi,r,k)||^2\right),$$

$$\underset{\beta(k)}{\operatorname{argmin}}\left(\sum_{\theta,\varphi,r}\rho(\theta,\varphi,r,k)(|Y(\theta,\varphi,r,k,\beta)|^2-|H_{ITE}(\theta,\varphi,r,k)|^2)^2\right),$$

$$\underset{\beta(k)}{\operatorname{argmin}}\left(\sum_{\theta,\varphi,r}\rho(\theta,\varphi,r,k)||Y(\theta,\varphi,r,k,\beta)|^2-|H_{ITE}(\theta,\varphi,r,k)|^2|\right).$$

where $\rho(\theta, \varphi, r, k)$ is a weighting function.

Other distance measures than the above may be used. As above, a (e.g. direction- and/or frequency-dependent) weighting function $\rho(\theta, \varphi, r, k)$ may be applied, e.g. to emphasize certain properties of the expected sound signals and/or of the geometrical setup. In an embodiment, $\rho(\theta, \varphi, r, k)=1$. Also, similar criteria may be expressed in relation to impulse responses $y(\theta, \varphi, r)$, $h_{ITE}(\theta, \varphi, r)$ of the beamformed signal (Y) and the ideally located microphone ($M_{ITE}$), respectively. Preferably, the impulse response ($h_{ITE}$)/transfer function ($H_{ITE}$) of the microphone ($M_{ITE}$) located at or in the ear canal are normalized with respect to the target direction (e.g. $H_{ITE}(\theta_{target})=1$, which matches that $Y(\theta_{target})=1$ for the target direction. A shaping corresponding to the shape of the directional pattern is aimed at. If a normalization is introduced, a compensation for the microphone response in the target direction can be applied afterwards (microphone location effect).

Contrary to minimizing the difference between the in-the-ear transfer functions and the hearing instrument transfer functions, one could also imagine a cost function based on other measures, such as optimizing towards having a directional response with a similar directivity index or a similar front-back ratio compared to the one of the in-the-ear recordings.

In an embodiment, the predefined criterion comprises minimizing a directional response of the beamformed signal to have a similar directivity index or a similar front-back ratio compared to the directivity index or the front-back ratio, respectively, of a microphone located at or in the ear canal (ITE).

In an embodiment, the predefined criterion comprises determining $W_1(k)$ and $W_2(k)$ according to one of the following expressions:

$$\underset{\beta(k)}{\operatorname{argmin}}(|DI_{pinna}(k) - DI_{ITE}(k)|),$$

$$\underset{\beta(k)}{\operatorname{argmin}}(|FBR_{pinna}(k) - FBR_{ITE}(k)|),$$

where the directivity index DI is given as the ratio between the response of the target direction $\theta_0$ and the response of all other directions, and the front-back ratio FBR is the ratio between the responses of the front half plane and the responses of the back half plane:

$$DI(k) = \log_{10}\frac{|R(\theta_0, k)|^2}{\int |R(\theta, k)|^2 \rho(\theta, k)d\theta}$$

$$FBR(k) = \log_{10}\frac{\int_{front} |R(\theta, k)|^2 \rho_{front}(\theta, k)d\theta}{\int_{back} |R(\theta, k)|^2 \rho_{back}(\theta, k)d\theta}$$

where $\rho_x(\theta, k)$ is a direction-dependent weighting function (x=front, back) either compensating for a non-uniform dataset or in order to take into account that some directions are more significant than other directions. Other ratios than the front-back ratio may alternatively be used, e.g. a ratio between the magnitude response (e.g. power density) in a smaller angle range (<180°) in the target direction, and the magnitude response in a larger angle range (>180°, remaining) in non-target directions (or vice versa).

In an embodiment, at least one of the transfer functions $H_{BTE1}(\theta, \varphi, r, k)$, $H_{BTE2}(\theta, \varphi, r, k)$, and $H_{ITE}(\theta, \varphi, r, k)$ is determined in less than three dimensions of space, e.g. in two dimensions, such as in a polar plane, and/or only in one dimension, such as in a polar plane, e.g. at one radial distance, e.g. $r_0$=3-5 m, or a distance $r_\infty$ corresponding to the acoustic far field.

In an embodiment, the predefined criterion comprises determining $W_1(k)$ and $W_2(k)$ according the following expression:

$$\underset{\beta(k)}{\operatorname{argmin}}\left(\sum_{\theta} (\log|Y(\theta, k, \beta)| - \log|H_{ITE}(\theta, k)|)^2\right),$$

As outlined above, other criteria (and/or a weighting function $\rho(\theta, \varphi, r, k)$) may be equivalently used to determine $W_1(k)$ and $W_2(k)$. Also, the criteria may be expressed in relation to time domain impulse responses.

In an embodiment, $\beta(k)$ is adapted so that null directions (or attenuation above a certain threshold (e.g. attenuation larger than 10 dB, such as larger than 5 dB, such as larger than 3 dB on the ipsi-lateral side)) are avoided to mimic the effect of a natural pinna that does not cancel out sounds completely from any direction, cf. e.g. our co-pending European patent application no. EP16164353.1, titled "A hearing device comprising a beamformer filtering unit", and filed at the European patent Office on 8 Apr. 2016, which is incorporated herein by reference.

A Computer Readable Medium:

In an aspect, a tangible computer-readable medium storing a computer program comprising program code means for causing a data processing system to perform at least some (such as a majority or all) of the steps of the method described above, in the 'detailed description of embodiments' and in the claims, when said computer program is executed on the data processing system is furthermore provided by the present application.

By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media. In addition to being stored on a tangible medium, the computer program can also be transmitted via a transmission medium such as a wired or wireless link or a network, e.g. the Internet, and loaded into a data processing system for being executed at a location different from that of the tangible medium.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application.

A Hearing System:

In a further aspect, a hearing system comprising a hearing aid as described above, in the 'detailed description of embodiments', and in the claims, AND an auxiliary device is moreover provided.

In an embodiment, the system is adapted to establish a communication link between the hearing aid and the auxiliary device to provide that information (e.g. control and status signals, possibly audio signals) can be exchanged or forwarded from one to the other.

In an embodiment, the auxiliary device is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the hearing aid. In an embodiment, the auxiliary device is or comprises a remote control for controlling functionality and operation of the hearing aid(s). In an embodiment, the function of a remote control is implemented in a SmartPhone, the SmartPhone possibly running an APP allowing to control the functionality of the audio processing device via the SmartPhone (the hearing aid(s) comprising an appropriate wireless interface to the SmartPhone, e.g. based on Bluetooth or some other standardized or proprietary scheme).

In an embodiment, the auxiliary device is another hearing aid. In an embodiment, the hearing system comprises two hearing aids adapted to implement a binaural hearing system, e.g. a binaural hearing aid system.

An APP:

In a further aspect, a non-transitory application, termed an APP, is furthermore provided by the present disclosure. The APP comprises executable instructions configured to be executed on an auxiliary device to implement a user interface for a hearing device or a hearing system described above in the 'detailed description of embodiments', and in the claims. In an embodiment, the APP is configured to run on cellular phone, e.g. a smartphone, or on another portable device allowing communication with said hearing device or said hearing system.

In an embodiment, the user interface is adapted to allow a user to emphasize a direction to and/or a frequency range of interest of a current sound source S in the environment of the user, thereby determining or influencing a weighting function for a current sound source of interest to the user, cf. e.g. the 'Sound source weighting APP' described in connection with FIG. 10. In an embodiment, the user interface is adapted to allow a user to qualify (e.g. accept or reject or modify) an adaptively determined weighting function for emphasizing a direction to or a frequency range of interest of a current sound source in the environment of the user.

Definitions

In the present context, a 'hearing aid' refers to a device, such as e.g. a hearing instrument or an active ear-protection device or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing aid' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing aid may be configured to be worn in any known way, e.g. as a unit arranged behind the ear with a tube leading radiated acoustic signals into the ear canal or with a loudspeaker arranged close to or in the ear canal, as a unit entirely or partly arranged in the pinna and/or in the ear canal, as a unit attached to a fixture implanted into the skull bone, as an entirely or partly implanted unit, etc. The hearing aid may comprise a single unit or several units communicating electronically with each other.

More generally, a hearing aid comprises an input transducer for receiving an acoustic signal from a user's surroundings and providing a corresponding input audio signal and/or a receiver for electronically (i.e. wired or wirelessly) receiving an input audio signal, a (typically configurable) signal processing circuit for processing the input audio signal and an output means for providing an audible signal to the user in dependence on the processed audio signal. In some hearing aids, an amplifier may constitute the signal processing circuit. The signal processing circuit typically comprises one or more (integrated or separate) memory elements for executing programs and/or for storing parameters used (or potentially used) in the processing and/or for storing information relevant for the function of the hearing aid and/or for storing information (e.g. processed information, e.g. provided by the signal processing circuit), e.g. for use in connection with an interface to a user and/or an interface to a programming device. In some hearing aids, the output means may comprise an output transducer, such as e.g. a loudspeaker for providing an air-borne acoustic signal or a vibrator for providing a structure-borne or liquid-borne acoustic signal. In some hearing aids, the output means may comprise one or more output electrodes for providing electric signals.

In some hearing aids, the vibrator may be adapted to provide a structure-borne acoustic signal transcutaneously or percutaneously to the skull bone. In some hearing aids, the vibrator may be implanted in the middle ear and/or in the inner ear. In some hearing aids, the vibrator may be adapted to provide a structure-borne acoustic signal to a middle-ear bone and/or to the cochlea. In some hearing aids, the vibrator may be adapted to provide a liquid-borne acoustic signal to the cochlear liquid, e.g. through the oval window. In some hearing aids, the output electrodes may be implanted in the cochlea or on the inside of the skull bone and may be adapted to provide the electric signals to the hair cells of the cochlea, to one or more hearing nerves, to the auditory cortex and/or to other parts of the cerebral cortex.

A 'hearing system' may refer to a system comprising one or two hearing aids or one or two hearing aids and an auxiliary device, and a 'binaural hearing system' refers to a system comprising two hearing aids and being adapted to cooperatively provide audible signals to both of the user's ears. Hearing systems or binaural hearing systems may further comprise one or more 'auxiliary devices', which communicate with the hearing aid(s) and affect and/or benefit from the function of the hearing aid(s). Auxiliary devices may be e.g. remote controls, audio gateway devices, mobile phones (e.g. SmartPhones), public-address systems, car audio systems or music players. Hearing aids, hearing systems or binaural hearing systems may e.g. be used for compensating for a hearing-impaired person's loss of hearing capability, augmenting or protecting a normal-hearing person's hearing capability and/or conveying electronic audio signals to a person.

Embodiments of the disclosure may e.g. be useful in applications such as hearing instruments, headsets, ear phones, active ear protection systems, or combinations thereof.

BRIEF DESCRIPTION OF DRAWINGS

The patent or application file contains at least one color drawings. Copies of this patent or patent application publication with color drawings will be provided by the USPTO upon request and payment of the necessary fee.

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

The figures are schematic and simplified for clarity, and they just show details which are essential to the understanding of the disclosure, while other details are left out. Throughout, the same reference signs are used for identical or corresponding parts.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

The detailed description set forth below in connection with the appended drawings is intended as a description of various configurations. The detailed description includes specific details for the purpose of providing a thorough understanding of various concepts. However, it will be apparent to those skilled in the art that these concepts may be practised without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

The present application relates to the field of hearing aids, e.g. hearing instruments configured to augment a hearing sensation of a user, e.g. to compensate for a hearing impairment. The application relates to the capture of sound signals around the user using microphones located on the user's body, e.g. at an ear, such as behind an ear of the user. Specifically when a sound signal is picked up by microphones located in a BTE-part behind an ear of a user, the microphones will have a tendency to (over-) emphasize signals from behind the user compared to signals from a frontal direction (cf. e.g. $H_{BTE}$ in FIG. 3). The present disclosure provides a scheme for compensating an inherent preference to signals from other directions than a target direction (e.g. the front) in a hearing aid comprising microphones located at non-ideal positions away from the ear canal).

Figure 1A:
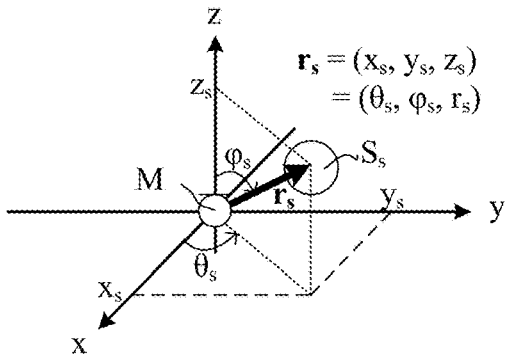
FIG. 1A shows a geometrical setup for a listening situation, illustrating a microphone of a hearing aid located at the centre (0, 0, 0) of a spherical coordinate system with a sound source located at (θ, φ, r)

FIG. 1A shows a geometrical setup for a listening situation, illustrating a microphone (M) of a hearing aid located at the centre (0, 0, 0) of a coordinate system (x, y, z) or (θ, r) with a sound source $S_s$ located at ($x_s$, $y_s$, $z_s$) or ($\theta_s$, $\varphi_s$, $r_s$). FIG. 1A defines coordinates of a spherical coordinate system (θ, φ, r) in an orthogonal coordinate system (x, y, z). A given point in three dimensional space, here illustrated by a location of sound source $S_s$, is represented by a vector $r_s$ from the center of the coordinate system (0, 0, 0) to the location ($x_s$, $y_s$, $z_s$) of the sound source $S_s$ in the orthogonal coordinate system. The same point is represented by spherical coordinates ($\theta_s$, $\varphi_s$, $r_s$) where $r_s$ is the radial distance to the sound source $S_s$, $\varphi_s$ is the (polar) angle from the z-axis of the orthogonal coordinate system (x, y, z) to the vector $r_s$, and $\theta_s$, is the (azimuth) angle from the x-axis to a projection of the vector $r_s$ in the xy-plane (z=0) of the orthogonal coordinate system.

Figure 1B:
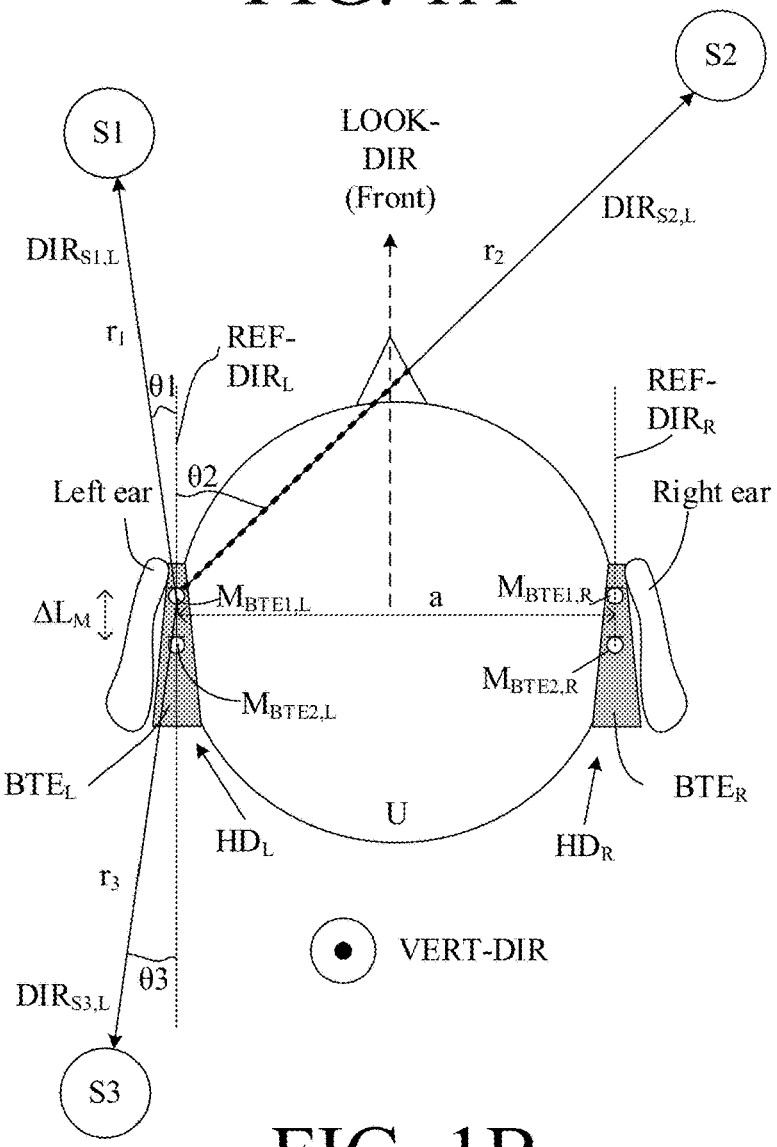
FIG. 1B shows a hearing aid user wearing left and right hearing aids in a listening situation comprising different sound sources located at different points in space relative to the user.

FIG. 1B shows a hearing aid user (U) wearing left and right hearing aids ($HD_L$, $HD_R$) (forming a binaural hearing aid system) in a listening situation comprising different sound sources ($S_1$, $S_2$, $S_3$) located at different points in space ($\theta_s$, $r_s$, ($\varphi_s$=$\varphi_0$), s=1, 2, 3) relative to the user (or the same sound source S located at different positions (1, 2, 3)). Each of the left and right hearing aids ($HD_L$, $HD_R$) comprises a part, termed a BTE-part (BTE). Each BTE-part ($BTE_L$, $BTE_R$) is adapted for being located behind an ear (Left ear, Right ear) of the user (U). A BTE-part comprises first ('Front') and second ('Rear') microphones ($M_{BTE1,L}$, $M_{BTE2,L}$; $M_{BTE1,R}$, $M_{BTE2,R}$) for converting an input sound to first $IN_1$ and second $IN_2$ electric input signals (cf. e.g. FIG. 5A, 5B), respectively. The first and second microphones ($M_{BTE1}$, $M_{BTE2}$) of a given BTE-part, when located behind the relevant ear of the user (U), are characterized by transfer functions $H_{BTE1}$(θ, φ, r, k) and $H_{BTE2}$(θ, φ, r, k) representative of propagation of sound from a sound source S located at (θ, φ, r) around the BTE-part to the first and second microphones of the hearing aid ($HD_L$, $HD_R$) in question, where k is a frequency index. In the setup of FIG. 1B, the target signal is assumed to be in the frontal direction relative to the user (U) (cf. e.g. LOOK-DIR (Front) in FIG. 1B), i.e., (roughly) in the direction of the nose of the user, and of a microphone axis of the BTE-parts (cf. e.g. reference directions REF-$DIR_L$, REF-$DIR_R$, of the left and right BTE-parts ($BTE_L$, $BTE_R$) in FIG. 1B). The sound source(s) ($S_1$, $S_2$, $S_3$) are located around the user as defined by spatial coordinates, here spherical coordinates ($\theta_s$, $\varphi_s$, $r_s$), s=1, 2, 3, defined relative to the reference directions REF-$DIR_L$ for the left hearing aid ($HD_L$) (and correspondingly to REF-$DIR_R$ for the right hearing aid, $HD_R$).

The sound source(s) ($S_1$, $S_2$, $S_3$) are intended to schematically illustrate a measurement of transfer functions of sound from all relevant directions (defined by azimuth angle $\theta_s$) and distances ($r_s$) around the user (U). The directions for the left hearing aid $HD_L$ to the sound sources $S_s$ are indicated in FIG. 1B by $DIR_{Ss,L}$, s=1, 2, 3. The first and second microphones of a given BTE-part are located at predefined distance $\Delta L_M$ apart (often referred to as microphone distance d). The two BTE-parts ($BTE_L$, $BTE_R$) and thus the respective microphones of the left and right BTE-parts, are located a distance a apart, when mounted on the user's head in an operational mode. The view in FIG. 1B is a planar view in a horizontal plane through the microphones of the first and second hearing aids (perpendicular to a vertical direction, indicated by out-of-plane arrow VERT-DIR in FIG. 1B) and corresponding to plane z=0(φ=90°) in FIG. 1A. In a simplified model, it is assumed that the sound sources ($S_i$) are located in a horizontal plane (e.g. the one shown in FIG. 1B).

Figure 2A:
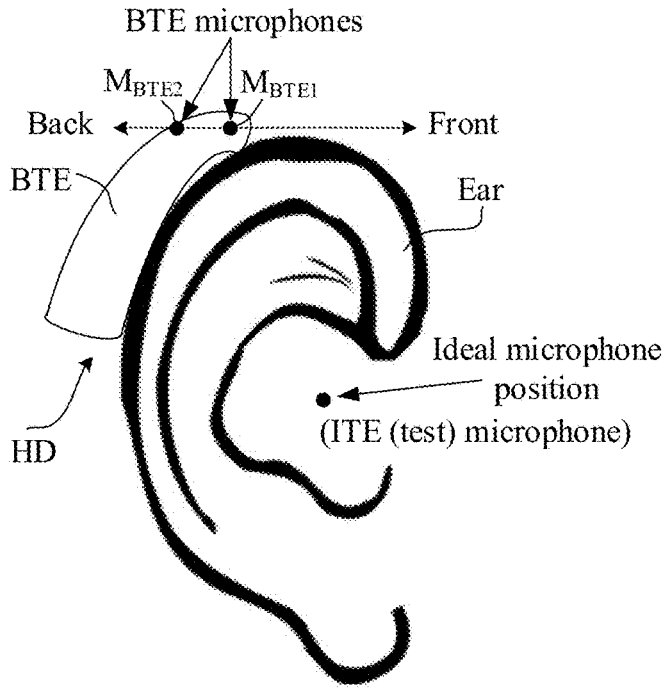
FIG. 2A shows a hearing aid comprising a BTE part having two microphones operationally mounted behind an ear of the user.

FIG. 2A shows an exemplary use case of a hearing aid (HD) according to the present disclosure. The hearing aid (HD) comprises a BTE part (BTE) comprising two microphones ($M_1$, $M_2$, denoted BTE microphones, $M_{BTE1}$, $M_{BTE2}$ in FIG. 2A) is mounted in an operational position behind an ear (Ear) of the user. In addition to the BTE-part containing two microphones, the hearing aid may comprise further parts, e.g. an ITE-part adapted for being located at or in the ear canal. The ITE-part may e.g. comprise a loudspeaker for presenting sound to the user (cf. e.g. FIG. 8). Alternatively or additionally, the hearing aid may comprise a fully or partially implanted part for electrically stimulating the cochlear nerve or a vibrator for transferring vibrations representing sound to bones of the skull. Since the BTE-part comprising the BTE microphones is placed at, and typically behind, the ear (pinna, Ear in FIG. 2A), even if located in an upper section of the BTE-part (as shown in FIG. 2A), the spatial perception of sound direction becomes disturbed (due to the shadowing effect of pinna towards sound from the front (and other directions of the frontal half plane, and from certain angles of the rear half-plane as well). The most natural spatial perception can be obtained by having a microphone placed close to the eardrum, e.g. at or in the ear canal (cf. indication Ideal microphone position, (ITE (test) microphone) in FIG. 2A). When the BTE-part is properly mounted at the ear of the user, the BTE-microphones ($M_{BTE1}$, $M_{BTE2}$) are preferably located horizontally so that a line through the two microphones defines front and rear directions relative to the user (cf. dotted arrow denoted Front and Back in FIG. 2A). In an embodiment, the only microphones of the hearing aid are the BTE-microphones, e.g. two BTE-microphones as illustrated in FIG. 2A. In an embodiment, the hearing aid comprises more than two microphones, e.g. three or more. In an embodiment, the hearing aid optionally comprises a microphone (termed an ITE-microphone) located near the ideal microphone position, e.g. at or in the ear canal (cf. e.g. FIG. 8). In an embodiment, the ITE-microphone is used to pick up sound from the environment in a first mode of operation, whereas the BTE-microphones are used to pick up sound from the environment in a second mode of operation (e.g. if feedback from the output transducer (e.g. a loudspeaker) to the ITE-microphone is of concern). In a further mode of operation, a combination of the BTE-microphones and the ITE-microphones is used to generate a beamformed signal (e.g. if a large directivity is intended).

Figure 2B:
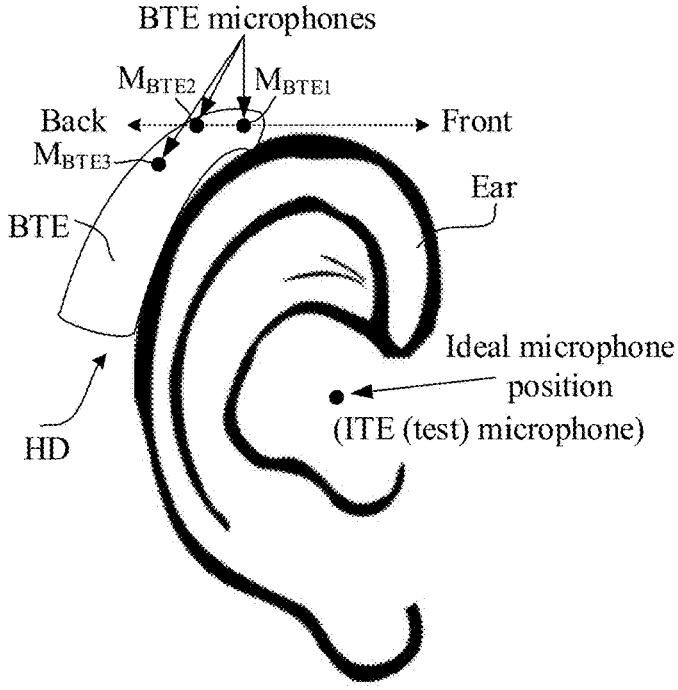
FIG. 2B shows a hearing aid comprising a BTE part having three microphones operationally mounted behind an ear of the user.

FIG. 2B shows a hearing aid comprising a BTE part having three (instead of two as in FIG. 2A) microphones operationally mounted behind an ear of the user. The embodiment of FIG. 2B resembles the embodiment of FIG. 2B but the BTE-part comprises three microphones. In this embodiment, the BTE-microphones ($M_{BTE1}$, $M_{BTE2}$, $M_{BTE3}$) are not located in the same horizontal plane (the first and second microphones $M_{BTE1}$ and $M_{BTE2}$ are located in a horizontal plane, whereas the third microphone $M_{BTE3}$ is not). Preferably in a triangle, where two of the microphones are located in the horizontal plane. This has the advantage of increasing the opportunities of forming a directional pattern, e.g. that the directional pattern can be adapted not only to the directional ITE response in the horizontal plane, but the directional pattern towards the directional ITE response measured at other elevation angles can also be optimized.

Figure 3:
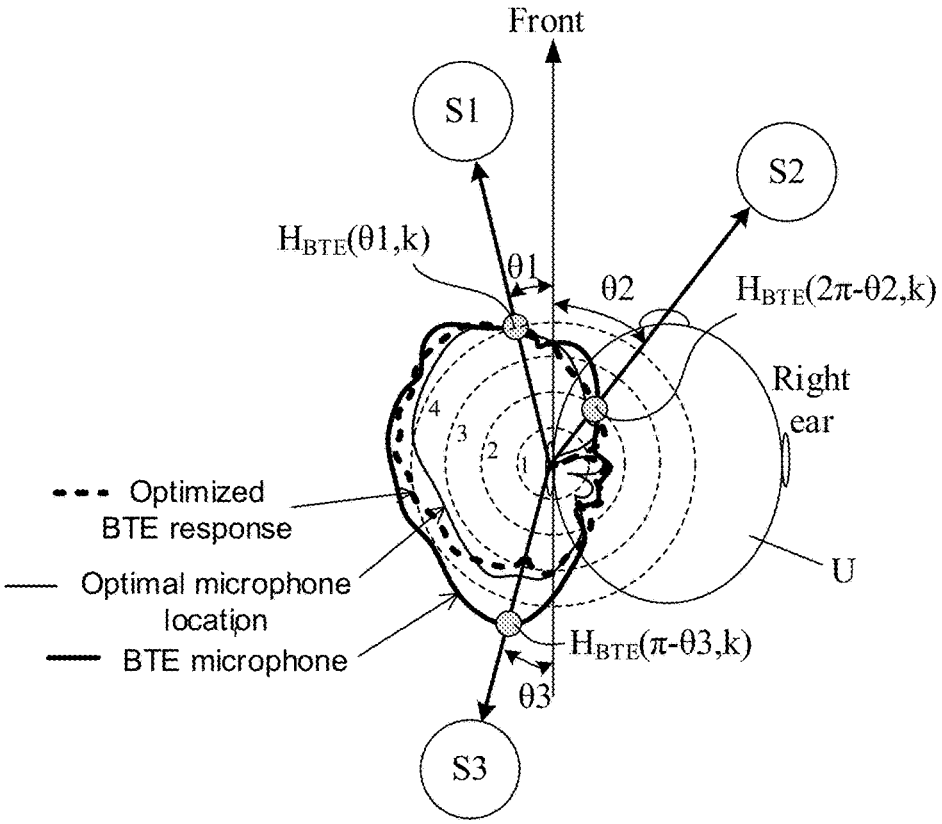
FIG. 3 shows an example of a directional polar response for a given frequency band k for a BTE-microphone (bold solid line), for an optimally located (ear canal) microphone (thin solid line), and for an optimized BTE-microphone (bold dashed line) according to the present disclosure.

FIG. 3 shows an example of a directional polar response for a given frequency band (k) for a BTE-microphone (bold solid line), for an optimally located (ear canal) microphone (thin solid line), and for an optimized BTE-microphone (bold dashed line) according to the present disclosure. The BTE-microphone may e.g. be one of the BTE-microphones ($M_{BTE1}$, $M_{BTE2}$) as shown in FIG. 1B or FIG. 2A. The optimally located (ear canal) microphone may e.g. be an ITE-microphone as illustrated in FIG. 2A (ITE (test) microphone) or ITE-microphone ($M_{ITE}$) of FIG. 8. The polar response for the optimized BTE-microphone may e.g. represent the polar response of beamformed signal Yin FIG. 5A, 5B or FIG. 6A, 6B or FIG. 7A, 7B.

FIG. 3 illustrates and example showing the directional polar response for a given frequency band, e.g. above 1.5 kHz for a scenario as illustrated by left hearing aid ($HD_L$) in FIG. 1B. The directional response is shown for the horizontal plane only (e.g. z=0 (φ=90°) in FIG. 1A, 1B), but it is easy to imagine that also the response from other elevation angles (φ≠90°) are included (spherical response). Due to the head location and the shadowing effect of the head (cf. e.g. dashed part of path $r_2$ from source $S_2$ to the (front) BTE-microphone $M_{BTE1,L}$ of left hearing aid ($HD_L$) in FIG. 1B), the response (of the left ear) has an asymmetric left-right response (cf. e.g. point $H_{BTE}(2\pi-\theta_2,k)$ for location of source $S_2$ in FIG. 3). Due to the position behind the ear (cf. e.g. FIG. 1B), the directional response of the BTE microphone(s) has significantly more gain towards the back (cf. e.g. point $H_{BTE}(\pi-\theta_3,k)$ for location of source $S_3$ in FIG. 3) compared to an optimal microphone position closer to the eardrum (cf. thin line polar plot denoted Optimal microphone location in FIG. 3). Signals from the front of the user are attenuated by the ear (pinna), 'behind' which the BTE-part comprising the BTE-microphones is situated (cf. e.g. point $H_{BTE}(\theta_1,k)$ for location of source $S_1$ in FIG. 3). The (unmodified) directional BTE response (cf. polar plot denoted BTE microphone in FIG. 3) is thus likely to introduce front-back localization confusions. The 'data points' (three shaded circles) of the transfer function for a BTE-microphone (located at the left ear), corresponding to directions defined by angles $\theta_1$, $\theta_2$, $\theta_3$, illustrate that the response $H_{BTE}(\pi-\theta_3, k)$ from the rear ($S_3$) is larger than a response from the front $H_{BTE}(\theta_1,k)$ ($S_1$), which again is larger than a response $H_{BTE}(2\pi-\theta_2,k)$ from the right ($S_2$) (cf. indications 1, 2, 3, 4, on the dashed circles having their center at the left ear microphone(s)). It is assumed that the sound sources $S_1$, $S_2$, $S_3$ are located at substantially the same distance r from the left ear of the user ($r_1=r_2=r_3$).

By combining the directional response of the two (or more) BTE microphones (providing polar plot denoted Optimized BTE response in FIG. 3), it is possible to obtain a directional response of the BTE hearing instrument, which is closer to the response at the ear canal (cf. polar plot denoted Optimal microphone location in FIG. 3).

It is possible to obtain a dataset consisting of recorded measured (or simulated or both) hearing aid microphone responses $h_{BTE1}(\theta, \varphi, r)$, $h_{BTE2}(\theta, \varphi, r)$ from different locations. $h_{BTE1}(\theta, \varphi, r)$ and $h_{BTE2}(\theta, \varphi, r)$ are vectors formulated in the time domain, but could as well consist of (complex) numbers formulated in the frequency domain $H_{BTE1}(\theta, \varphi, r, k)$ and $H_{BTE2}(\theta, \varphi, T, k)$, where k is a frequency (band) index. Further a similar recorded (or simulated or both) microphone response close to or in the ear canal (ITE), $h_{ITE}(\theta, \varphi, r)$ or $H_{ITE}(\theta, \varphi, r, k)$ (Containing the correct pinna reflections) may be obtained. θ indicates the azimuth angle, φ is the elevation angle, and r is the source distance from the microphone in question. By combining the recorded BTE microphone signals (1 and 2) it is possible to obtain a different directional transfer function which is better at mimicking the pinna (here formulated in the time-domain), i.e.

$$h_{pinna}(\theta,\varphi,r)=w_1*h_{BTE1}(\theta,\varphi,r)+w_2*h_{BTE2}(\theta,\varphi,r),$$

where $w_1$ and $w_2$ are filters applied to the first and the second microphone signals, respectively, and * denotes the convolution operator. Our objective is thus to find $w_1$ and $w_2$ (optimized sets, $w_1'$ and $w_2'$, of filter coefficients) such that a difference measure, e.g. the (magnitude) response difference, between the BTE pinna response and the ideal directional response is minimized, i.e. fulfills the following expression $$\underset{w_1,w_2}{\operatorname{argmin}}\left(\sum_{\theta,\varphi,r}\rho(\theta,\varphi,r)(\log|h_{pinna}(\theta,\varphi,r)|-\log|h_{ITE}(\theta,\varphi,r)|)^2\right),$$

where ρ(θ, φ, r) is a weighting function.

One could as well imagine other cost functions or distance measures:

$$\underset{w_1,w_2}{\operatorname{argmin}}\left(\sum_{\theta,\varphi,r}\rho(\theta,\varphi,r)|\log|h_{pinna}(\theta,\varphi,r)|-\log|h_{ITE}(\theta,\varphi,r)||\right),$$

$$\underset{w_1,w_2}{\operatorname{argmin}}\left(\sum_{\theta,\varphi,r}\rho(\theta,\varphi,r)||h_{pinna}(\theta,\varphi,r)|-|h_{ITE}(\theta,\varphi,r)||\right),$$

$$\underset{w_1,w_2}{\operatorname{argmin}}\left(\sum_{\theta,\varphi,r}\rho(\theta,\varphi,r)||h_{pinna}(\theta,\varphi,r)|-|h_{ITE}(\theta,\varphi,r)||^2\right),$$

$$\underset{w_1,w_2}{\operatorname{argmin}}\left(\sum_{\theta,\varphi,r}\rho(\theta,\varphi,r)(|h_{pinna}(\theta,\varphi,r)|^2-|h_{ITE}(\theta,\varphi,r)|^2)^2\right),$$

$$\underset{w_1,w_2}{\operatorname{argmin}}\left(\sum_{\theta,\varphi,r}\rho(\theta,\varphi,r)||h_{pinna}(\theta,\varphi,r)|^2-|h_{ITE}(\theta,\varphi,r)|^2|\right),$$

The cost function can easily be expanded to include more than two microphones.

The criteria may alternatively be expressed in the time-frequency domain to provide optimized complex, frequency dependent parameters $W_1(k)'$ and $W_2(k)'$, based on transfer functions $H_x(\theta, \varphi, r, k)$ (where x=pinna, ITE, and k is a frequency index).

The weighting function ρ(θ, φ, r) can be used to compensate e.g. if the data are not uniformly recorded (e.g. conversion to spherical coordinates), or for emphasizing perceptual significant directions in the optimization, or to introduce a dependence of a current direction to the target (or dominating) signal.

FIG. 3 illustrates the principle of the proposed scheme. In this case, we solely consider the directional response in the horizontal plane (φ=90°, cf. FIG. 1A), e.g. for a predetermined distance or range of distances r between sound source $S_s$ (s=1, 2, 3 in FIG. 3) and hearing aid microphones (M in FIG. 1A), e.g. in the acoustic far field. In this case, for a given frequency band (k), we have found the optimal combination of the BTE microphones in order to achieve a response similar to an in-the-ear microphone response, i.e.

$$\underset{w_1(k),w_2(k)}{\operatorname{argmin}}\left(\sum_{\theta}(\log|H_{pinna}(\theta,k)|-\log|H_{ITE}(\theta,k)|)^2\right),$$

where k denotes the frequency band index.

Often the response of the BTE microphones is constrained such that the response at a certain direction (and/or frequency) has a response similar to the response at the ideal microphone location for the same direction. This may e.g. be achieved by combining the microphones such that the combined response Y(k) is given by $$Y(k)=O(k)-\beta(k)C(k),$$

where O(k) is an omnidirectional delay and sum beamformer having a desired response in the target direction $\theta_0$ and C (k) is a target cancelling beamformer having a null response towards the target direction, cf. e.g. EP2701145A1. β(k) is a, possibly complex numbered, parameter controlling the shape of the directional beam pattern. As β is applied to the target cancelling beamformer, the response towards the target direction is independent of β. We thus only have a single parameter to optimize, i.e.

$$\underset{\beta(k)}{\operatorname{argmin}}\left(\sum_{\theta}(\log|Y(\theta,k,\beta)|-\log|H_{ITE}(\theta,k)|)^2\right),$$

The minimization of the expression above may e.g. be found by an exhaustive search across a range of β-values. Other methods, e.g. minimization algorithms, may be used.

Contrary to minimizing the difference between the in-the-ear transfer functions and the hearing instrument transfer functions one could also imagine a cost function based on other measures, such as optimizing towards having a directional response with a similar directivity index (DI) or a similar front-back ratio (FBR) compared to the in-the-ear recordings, i.e.

$$\underset{\beta(k)}{\operatorname{argmin}}(|DI_{pinna}(k)-DI_{ITE}(k)|),$$

$$\underset{\beta(k)}{\operatorname{argmin}}(|FBR_{pinna}(k)-FBR_{ITE}(k)|),$$

where the DI is given as the ratio between the response of the target direction $\theta_0$ and the response of all other directions, and the FBR is the ratio between the responses of the front half plane and the responses of the back half plane:

$$DI=\log_{10}\frac{|R(\theta_0)|^2}{\int|R(\theta)|^2\rho(\theta)d\theta}$$

$$FBR=\log_{10}\frac{\int_{front}|R(\theta)|^2\rho_{front}(\theta)d\theta}{\int_{back}|R(\theta)|^2\rho_{back}(\theta)d\theta}$$

where ρ(θ) is a direction-dependent weighting function either compensating for a non-uniform dataset or in order to take into account that some directions are more significant than other directions. The dependence on a front-back ratio (FBR) in the above expressions may alternatively be substituted by a ratio between any two appropriately selected ranges of directions.

Figure 4:
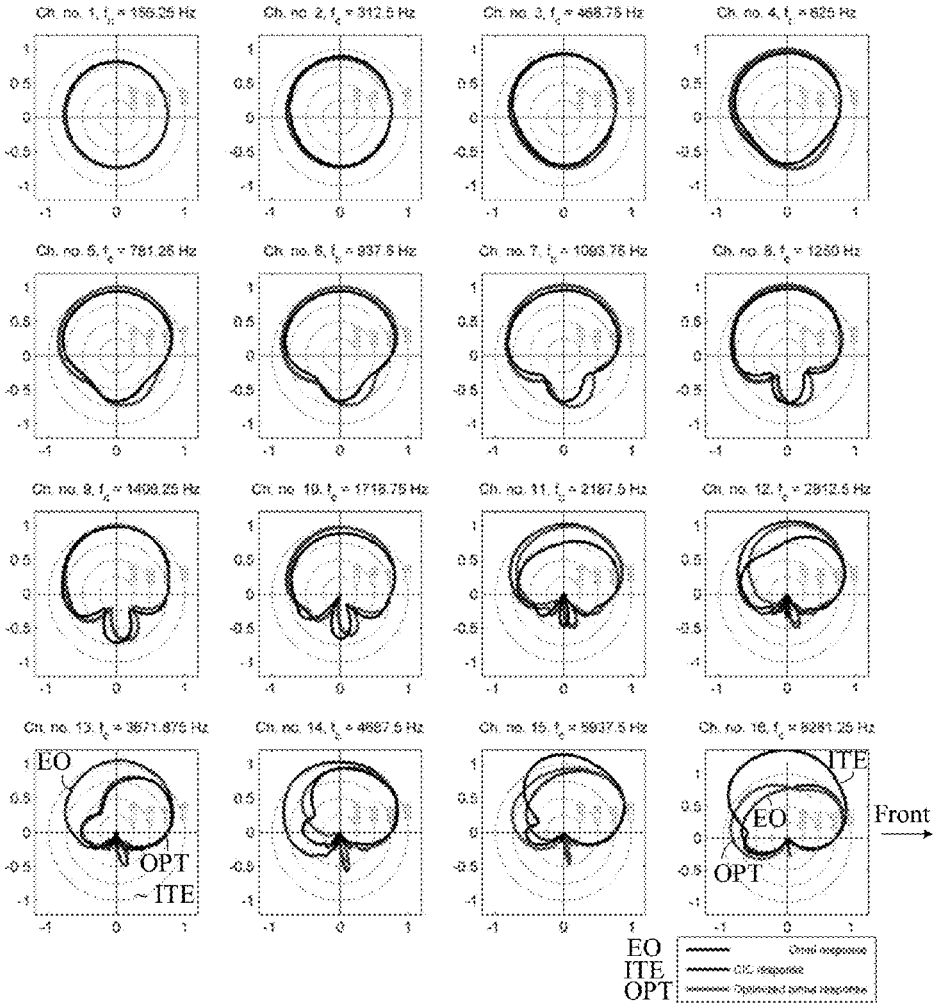
FIG. 4 shows examples of directional polar responses at different frequency bands having center frequencies from from 150 Hz (upper left graph) to 8 kHz (lower right graph) for an omni-directional beamformer (sum of two BTE-microphones), for an optimally located (ear canal, CIC) microphone, and for an optimized BTE-microphone according to the present disclosure.

FIG. 4 shows examples of directional polar responses at different frequencies from 150 Hz (upper left graphs) to 8 kHz (lower right graphs) for an omni beamformer (sum of two BTE-microphones, denoted Omni response (EO) in FIG. 4), for an optimally located microphone (denoted CIC response (ITE) in FIG. 4), and for an optimized BTE-microphone response according to the present disclosure (denoted Optimized pinna response (OPT) in FIG. 4). FIG. 4 is intended to (schematically) illustrate the frequency dependence of the polar response of microphones (which is at least partially due to the different propagation and reflection properties of the human body and the different resonance properties of the ear (pinna) at different frequencies). It further illustrates that the resemblance of the optimized response of two BTE-microphones to that of the optimally located microphone is different at different frequencies. The optimized response generally depends on the predefined criterion used to determine sets of filter constants $w_1'$, $w_2'$ of the fixed optimized beamformer (or equivalently the complex, frequency dependent parameters $W_1(k)'$, $W_2(k)'$). A close to perfect fit is observed at relatively low frequencies (reflecting that the response of the BTE- and optimally located microphone are nearly equal at frequencies below 1.5 kHz). It is typically not possible to get a 'perfect fit' of the two responses over all frequencies, which is clearly reflected in the example of FIG. 4 by comparison of responses at approximately 8.3 kHz (lower right graphs) and 3.7 kHz (lower left graphs). At 3.7 kHz, the optimized response (OPT) is close to the response (ITE) for the optimally located microphone. At 8.3 kHz, all three responses are different, and the optimized response (OPT) is relatively far from the response (ITE) for the optimally located microphone. The weighting function ρ(θ, φ, r) may be used to manage the occurrence of such differences, e.g. to emphasize the importance of certain frequencies (e.g. where speech content is predominant, e.g. below 4 kHz). The measured transfer function $H_{ITE}$ at 8.3 kHz actually exhibits a higher gain in a backward direction (front direction is indicated by arrow denoted Front in FIG. 4). To avoid this bias, the transfer function $H_{ITE}$ at relatively high frequencies (e.g. the highest frequency band) may be modified (before it is used in the optimization procedure for determining complex weights $W_i(k)'$ or filter coefficients $w_i$ or adaptation parameter β(k).

Figure 5A:
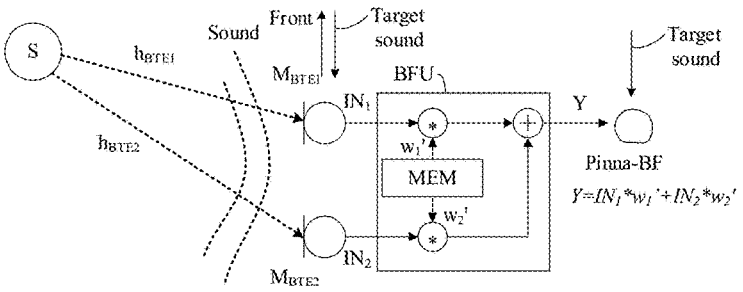
FIG. 5A shows a block diagram of a first exemplary 2-microphone beamformer configuration for use in a hearing aid according to the present disclosure.

FIG. 5A shows a block diagram of a first exemplary two-microphone beamformer configuration for use in a hearing aid according to the present disclosure. The hearing aid comprises first and second microphones ($M_{BTE1}$, $M_{BTE2}$) for converting an input sound (Sound) to first $IN_1$ and second $IN_2$ electric input signals, respectively. A front direction and the direction from the target signal to the hearing aid is e.g. defined by the microphone axis and indicated in FIGS. 5A (and 5B) by arrows denoted Front and Target sound, respectively (cf. REF-DIR in FIG. 1B). The first and second microphones (when located behind the ear of the user) are characterized by time-domain impulse responses $h_{BTE1}(\theta, \varphi, r)$ and $h_{BTE2}(\theta, \varphi, r)$ (or transfer functions $H_{BTE1}(\theta, \varphi, r, k)$ and $H_{BTE2}(\theta, \varphi, r, k)$ in the time-frequency domain) representative of propagation of sound from sound source S located at (θ, φ, r) around the hearing aid to the first and second microphones ($M_{BTE1}$, $M_{BTE2}$). The hearing aid comprises a memory unit (MEM) comprising filter coefficients $w_1'(w_{10}, w_{11}, w_{12}, \ldots)$ and $w_2'(w_{20}, w_{21}, w_{22}, \ldots)$. The hearing aid further comprises a beamformer filtering unit (BFU) for providing a beamformed signal Y (denoted Pinna BF) as a weighted combination of the first and second electric input signals using said filter coefficients $w_1$ and $w_2$: $Y=w_1'*IN_1+w_2'*IN_2$, where * denotes the convolution operator. In FIG. 5A the convolution operator "*" is represented by filters (e.g. FIR filters, applying filter coefficients $w_1'$ and $w_2'$, respectively), whereas '+' represent a summation unit. The filter coefficients $w_1'$ and $w_2'$ are determined (in advance of use of the hearing aid and stored in the memory unit MEM) to provide a resulting impulse response $$h_{pinna}(\theta,\varphi,r)=w_1*h_{BTE1}(\theta,\varphi,r)+w_2*h_{BTE2}(\theta,\varphi,r),$$

so that a difference between the resulting impulse response $h_{pinna}(\theta, \varphi, r, k)$ and an impulse response $h_{ITE}(\theta, \varphi, r)$ of a microphone located close to or in the ear canal (ITE) fulfils a predefined criterion.

Figure 5B:
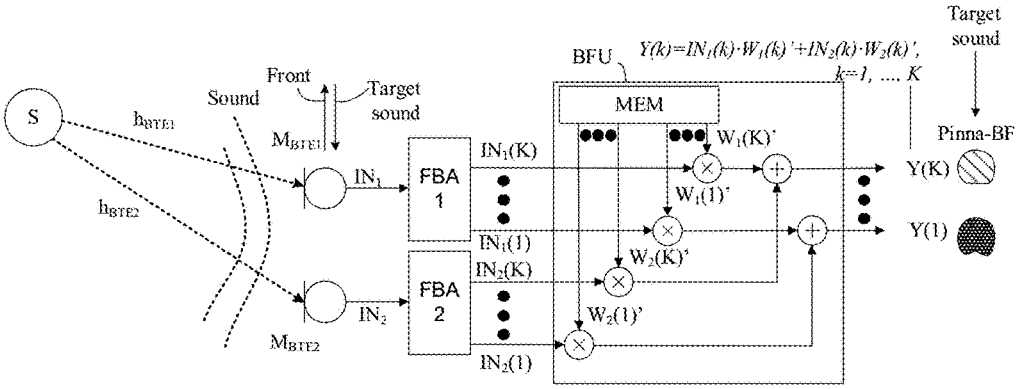
FIG. 5B shows a block diagram of a second exemplary 2-microphone beamformer configuration for use in a hearing aid according to the present disclosure.

FIG. 5B shows a block diagram of a second exemplary two-microphone beamformer configuration for use in a hearing according to the present disclosure. The beamformer configuration of FIG. 5B is equal to that of FIG. 5A, except that the beamformer configuration of FIG. 5B is configured to operate in the time-frequency domain. The beamformer configuration FIG. 5B comprises first and second microphones ($M_{BTE1}$, $M_{BTE2}$) for converting an input sound to first $IN_1$ and second $IN_2$ electric input signals, respectively.

First and second analysis filter bank units (FBA1 and FBA2) convert first and second time domain signals $IN_1$ and $IN_2$ to time-frequency domain signals $IN_i(k)$, i=1, 2, and k=1, 2, . . . , K, where K is the number of frequency bands. The memory unit (MEM) contains first and second complex constants $W_1(k)'$, $W_2(k)'$ (for each frequency band i=1, 2, . . . , K).

The beamformer filtering unit (BFU) is configured to provide beamformed signal Y as a weighted combination of the first and second electric input signals using the complex, frequency dependent constants $W_1(k)'$ and $W_2(k)'$stored in the memory unit (MEM): $Y(k)=W_1(k)'\cdot IN_1+W_2(k)'\cdot IN_2$, k=1, 2, . . . , K (denoted Pinna BF). In FIG. 5B units 'x' represent multiplication units for multiplying complex constants $W_1(k)'$ and $W_2(k)'$ onto respective band signals $IN_1(k)$ and $IN_2(k)$, respectively, k=1, 2, . . . , K, whereas '+' represent summation units. The complex constants $W_1(k)'$ and $W_2(k)'$ are determined (optimized) (in advance of use of the hearing aid and stored in the memory unit MEM) to provide a resulting transfer function:

$$H_{pinna}(\theta,\varphi,r,k)=W_1(k)\cdot H_{BTE1}(\theta,\varphi,r,k)+W_2(k)\cdot H_{BTE2}(\theta,\varphi,r,k),$$

so that a difference between the resulting transfer function $H_{pinna}$ (θ, φ, r, k) and a transfer function $H_{ITE}$(θ, φ, r, k) of a microphone located close to or in the ear canal (ITE) fulfils a predefined criterion.

Figure 6A:
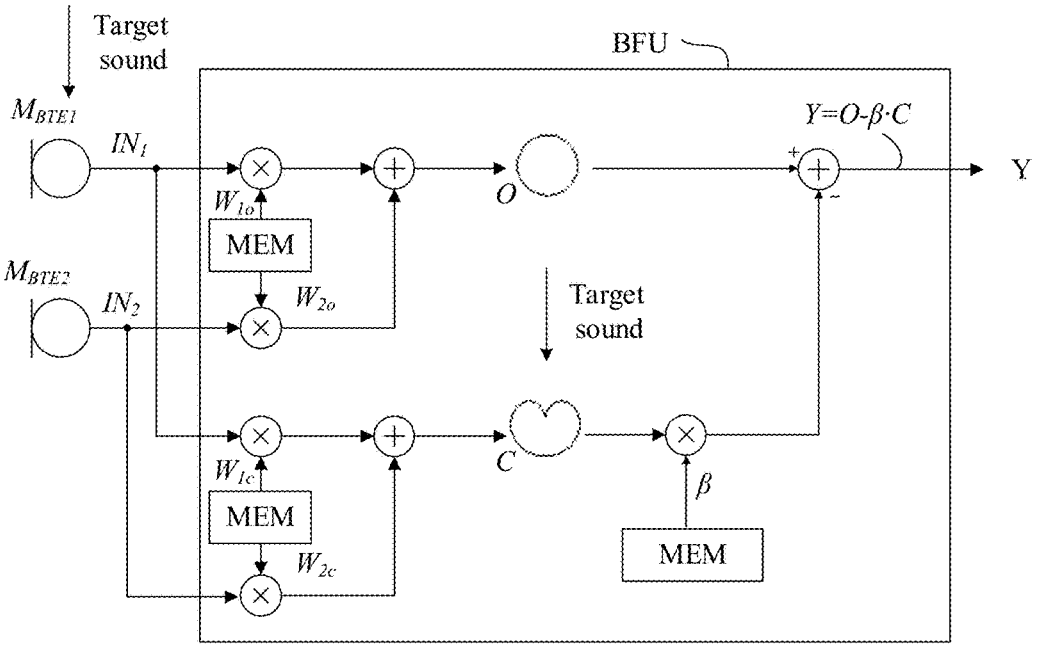
FIG. 6A shows a block diagram of a third exemplary 2-microphone beamformer configuration for use in a hearing aid according to the present disclosure.

FIG. 6A shows a block diagram of a third exemplary two-microphone beamformer configuration for use in a hearing aid according to the present disclosure. The beamformer configuration of FIG. 6A comprises first and second microphones ($M_{BTE1}$, $M_{BTE2}$) for converting an input sound to first $IN_1$ and second $IN_2$ electric input signals, respectively. A direction from the target signal to the hearing aid is e.g. defined by the microphone axis and indicated in FIGS. 6A (and 6B) by arrow denoted Target sound. The beamformer unit (BFU) comprises first and second fixed beamformers BF1 and BF2 in the form of different, weighted combinations of the first and second electric input signals $IN_1$ and $IN_2$, respectively. The first beamformer BF1 may represent a delay and sum beamformer providing (enhanced) omni-directional signal O. The second beamformer BF2 may represent a delay and subtract beamformer providing target-cancelling signal C. Each beamformer BF1, BF2 may be defined by frequency dependent complex weighting parameter sets ($W_{11}(k)=W_{1o}(k)$, $W_{21}(k)=W_{2o}(k)$) and ($W_{12}(k)=W_{1c}(k)$, $W_{22}(k)=W_{2c}(k)$), respectively, so that the fixed beamformers are given by $$O=\mathrm{BF1}(k)=W_{1o}(k)\cdot \mathrm{IN}_1+W_{2o}(k)\cdot \mathrm{IN}_2,$$

$$C=\mathrm{BF2}(k)=W_{1c}(k)\cdot \mathrm{IN}_1+W_{2c}(k)\cdot \mathrm{IN}_2,$$

In the embodiment of FIG. 6A, each of the first and second beamformers BF1, BF2 are implemented in the time-frequency domain (appropriate filter banks being implied) by two multiplication units 'x' and a sum unit '+'. The beamformer unit (BFU) comprises a further beamformer (implemented by further multiplication 'x' and summation units '+') for generating beamformed signal Y as a combination of said first and second fixed beamformers BF1 and BF2 (or beamformed signals) according to the following expression $$Y(k)=\mathrm{BF1}(k)-\beta(k)\cdot \mathrm{BF2}(k),$$

$$Y=O-\beta C$$

where β(k) is a frequency dependent parameter controlling the final shape of the directional beam pattern (of signal Y) of the beamformer filtering unit (BFU). In an embodiment, β represents the optimized beamformer based on a predefined criterion to minimize a difference between the polar response of the second (target cancelling) beamformer and the polar response of a microphone located at the ideal position at or in the ear canal. Since β(k) is only multiplied to the target cancelling beamformer (C), the response towards the target direction will (ideally) be unaffected when β(k) changes. The complex weighting parameter sets ($W_{1o}$(k), $W_{2o}$(k)), ($W_{1c}$(k), $W_{2c}$(k)), and β(k) are preferably stored in the memory unit MEM of the beamformer unit (BFU) or elsewhere in the hearing aid (e.g. implemented in firmware of hardware).

Figure 6B:
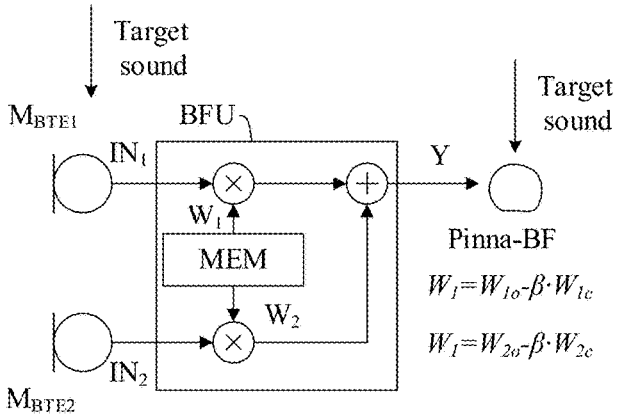
FIG. 6B shows an equivalent block diagram of the third exemplary 2-microphone beamformer configuration for use in a hearing aid according to the present disclosure.

FIG. 6B shows an equivalent block diagram of the exemplary two-microphone beamformer configuration shown in FIG. 6A. By insertion of the complex constants in the logic diagram of FIG. 6A, and re-arranging the elements, the following expression for Y appears:

$$Y(k)=(W_{1o}(k)-\beta(k)\cdot W_{1c}(k))\cdot \mathrm{IN}_1+(W_{2o}(k)-\beta(k)\cdot W_{2c}(k))\cdot \mathrm{IN}_2,$$

Hence the beamformer unit (BFU) of FIG. 6A may be implemented as the beamformer unit (BFU) of FIG. 6B where optimized complex constants $W_1=W_{1o}(k)-\beta(k)\cdot W_{1c}(k)$ and $W_2=W_{2o}(k)-\beta(k)\cdot W_{2c}(k)$ are stored in memory unit (MEM). The optimized constants $W_1(k)'$ and $W_2(k)'$ are determined by minimizing an expression for a distance measure (for each frequency band k) between the beamformed signal Y(θ, φ, r, k) and the transfer function $H_{ITE}$(θ, φ, r, k) of a microphone located at or in the ear canal (ITE) with respect to the parameter β(k). This configuration has the advantage that a single parameter β (for each frequency band, k) can be used to optimize the predefined criterion. This comes at the cost of requiring that a signal from the target direction in principle is unaltered (cannot be attenuated).

Figure 7A:
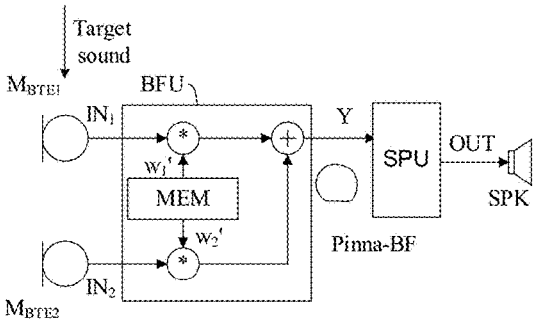
FIG. 7A shows a block diagram of a first embodiment of a hearing aid according to the present disclosure.

FIG. 7A shows a block diagram of a first embodiment of a hearing aid according to the present disclosure. The hearing aid of FIG. 7A comprises a 2-microphone beamformer configuration as shown in FIG. 5A and a signal processing unit (SPU) for (further) processing the beamformed signal Y and providing a processed signal OUT. A direction from the target signal to the hearing aid is e.g. defined by the microphone axis and indicated in FIGS. 7A (and 7B) by arrow denoted Target sound. The signal processing unit may be configured to apply a level and frequency dependent shaping of the beamformed signal, e.g. to compensate for a user's hearing impairment, and/or to compensate for the microphone location effect (MLE), and/or to compensate for an ear canal being blocked by an ear mould. The processed signal (OUT) is fed to an output unit for presentation to a user as a signal perceivable as sound. In the embodiment of FIG. 7A, the output unit comprises a loudspeaker (SPK) for presenting the processed signal (OUT) to the user as sound. The forward path from the microphones to the loudspeaker of the hearing aid may be operated in the time domain.

Figure 7B:
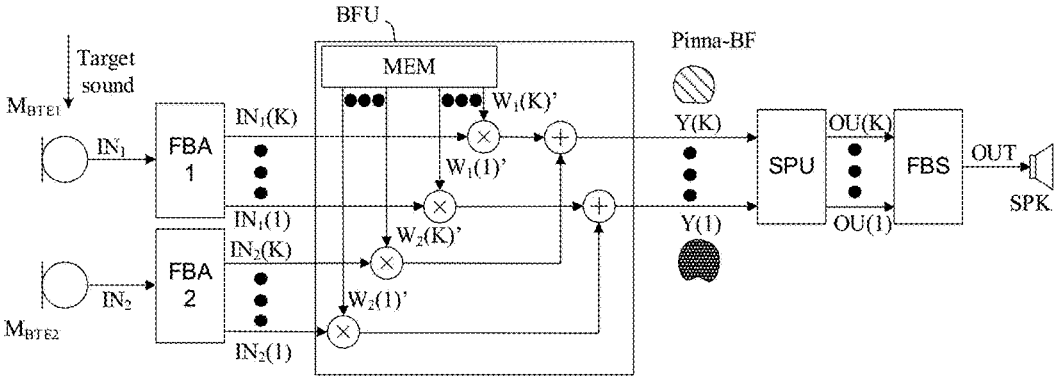
FIG. 7B shows a block diagram of a second embodiment of a hearing aid according to the present disclosure.

FIG. 7B shows a block diagram of a second embodiment of a hearing aid according to the present disclosure. The hearing aid of FIG. 7B comprises a 2-microphone beamformer configuration as shown in FIG. 5B and a signal processing unit (SPU) for (further) processing the beamformed signal Y(k) in a number (K) of frequency bands and providing a processed signal OU(k), k=1, 2, . . . , K. The signal processing unit may be configured to apply a level and frequency dependent shaping of the beamformed signal, e.g. to compensate for a user's hearing impairment. The processed frequency band signals OU(k) are fed to a synthesis filter bank FBS for converting the frequency band signals OU(k) to a single time-domain processed (output) signal OUT, which is fed to an output unit for presentation to a user as a signal perceivable as sound. In the embodiment of FIG. 7B, the output unit comprises a loudspeaker (SPK) for presenting the processed signal (OUT) to the user as sound. The forward path from the microphones ($M_{BTE1}$, $M_{BTE2}$) to the loudspeaker (SPK) of the hearing aid is (mainly) operated in the time-frequency domain (in K frequency bands).

Figure 8A:
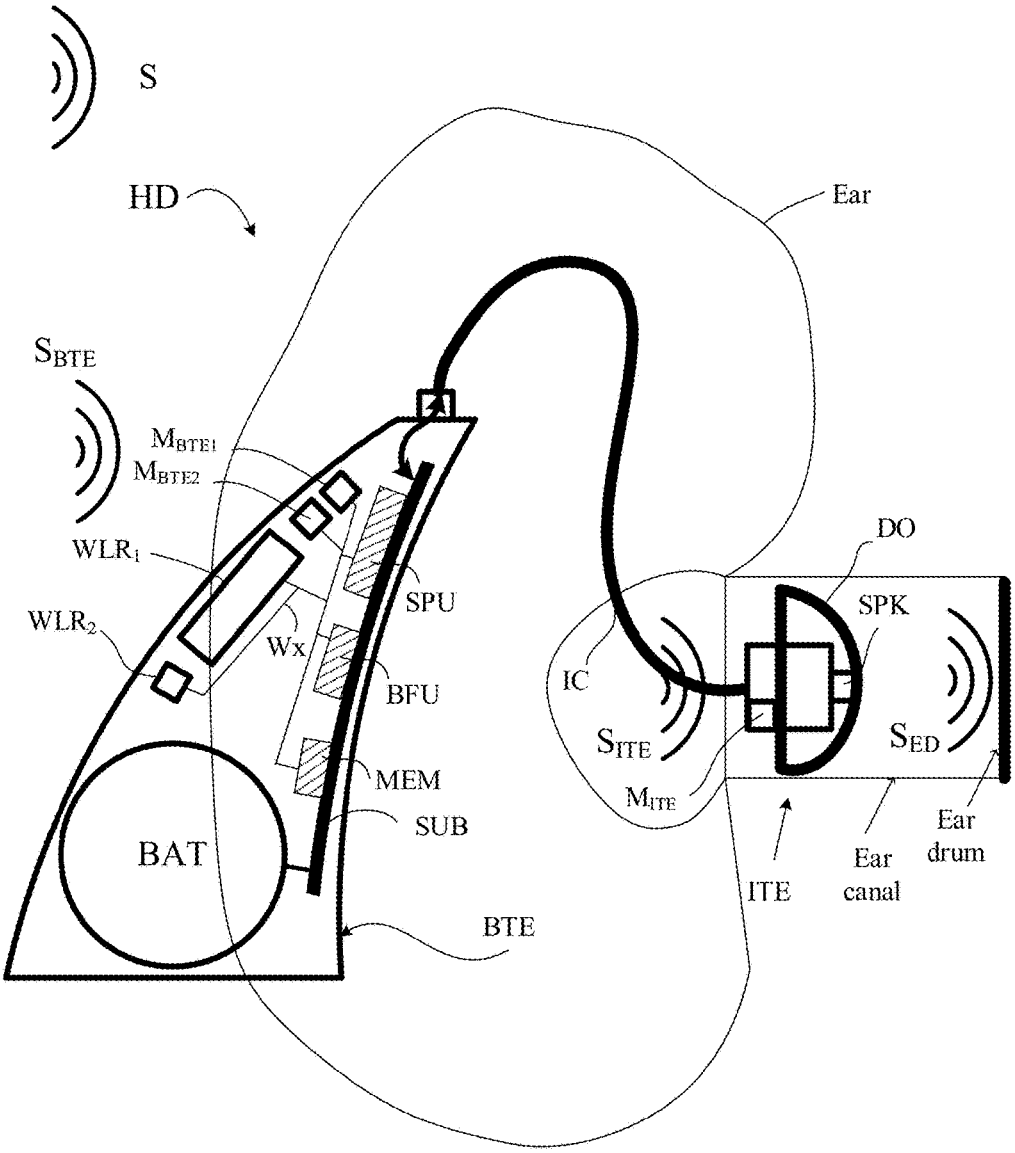
FIG. 8A shows a first embodiment of a hearing aid according to the present disclosure comprising a BTE-part located behind an ear of a user and an ITE part located in an ear canal of the user.

FIG. 8A illustrates an exemplary hearing aid (HD) formed as a receiver in the ear (RITE) type hearing aid comprising a BTE-part (BTE) adapted for being located behind pinna and a part (ITE) comprising an output transducer (OT, e.g. a loudspeaker/receiver) adapted for being located in an ear canal (Ear canal) of the user (e.g. exemplifying a hearing aid (HD) as shown in FIG. 7A, 7B). The BTE-part (BTE) and the ITE-part (ITE) are connected (e.g. electrically connected) by a connecting element (IC). In the embodiment of a hearing aid of FIG. 8A, the BTE part (BTE) comprises two input transducers (here microphones, M=2) ($M_{BTE1}$, $M_{BTE2}$) each for providing an electric input audio signal representative of an input sound signal ($S_{BTE}$) from the environment (in the scenario of FIG. 8A, from sound source S).

The hearing device of FIG. 8A further comprises two wireless receivers ($WLR_1$, $WLR_2$) for providing respective directly received auxiliary audio and/or information signals. The hearing aid (HD) further comprises a substrate (SUB) whereon a number of electronic components are mounted, functionally partitioned according to the application in question (analogue, digital, passive components, etc.), but including a configurable signal processing unit (SPU), a beamformer filtering unit (BFU), and a memory unit (MEM) coupled to each other and to input and output units via electrical conductors Wx. The configurable signal processing unit (SPU) provides an enhanced audio signal (cf. signal OUT in FIG. 7A, 7B), which is intended to be presented to a user. In the embodiment of a hearing aid device in FIG. 8A, the ITE part (ITE) comprises an output unit in the form of a loudspeaker (receiver) (SPK) for converting the electric signal (OUT) to an acoustic signal (providing, or contributing to, acoustic signal $S_{ED}$ at the ear drum (Ear drum). In an embodiment, the hearing aid comprises more than two microphones. In an embodiment, the BTE-part comprises more than two microphones (M>2, cf. e.g. FIG. 8B for M=3). In an embodiment, the ITE-part further comprises an input unit comprising an input transducer (e.g. a microphone) ($M_{ITE}$) for providing an electric input audio signal representative of an input sound signal $S_{ITE}$ from the environment at or in the ear canal. In another embodiment, the hearing aid may comprise only the BTE-microphones, e.g. two ($M_{BTE1}$, $M_{BTE2}$) or three ($M_{BTE1}$, $M_{BTE2}$, $M_{BTE3}$, cf. FIG. 8B) microphones. In yet another embodiment, the hearing aid may comprise an input unit ($IT_3$) located elsewhere than at the ear canal in combination with one or more input units located in the BTE-part. The ITE-part further comprises a guiding element, e.g. a dome, (DO) for guiding and positioning the ITE-part in the ear canal of the user.

Figure 8B:
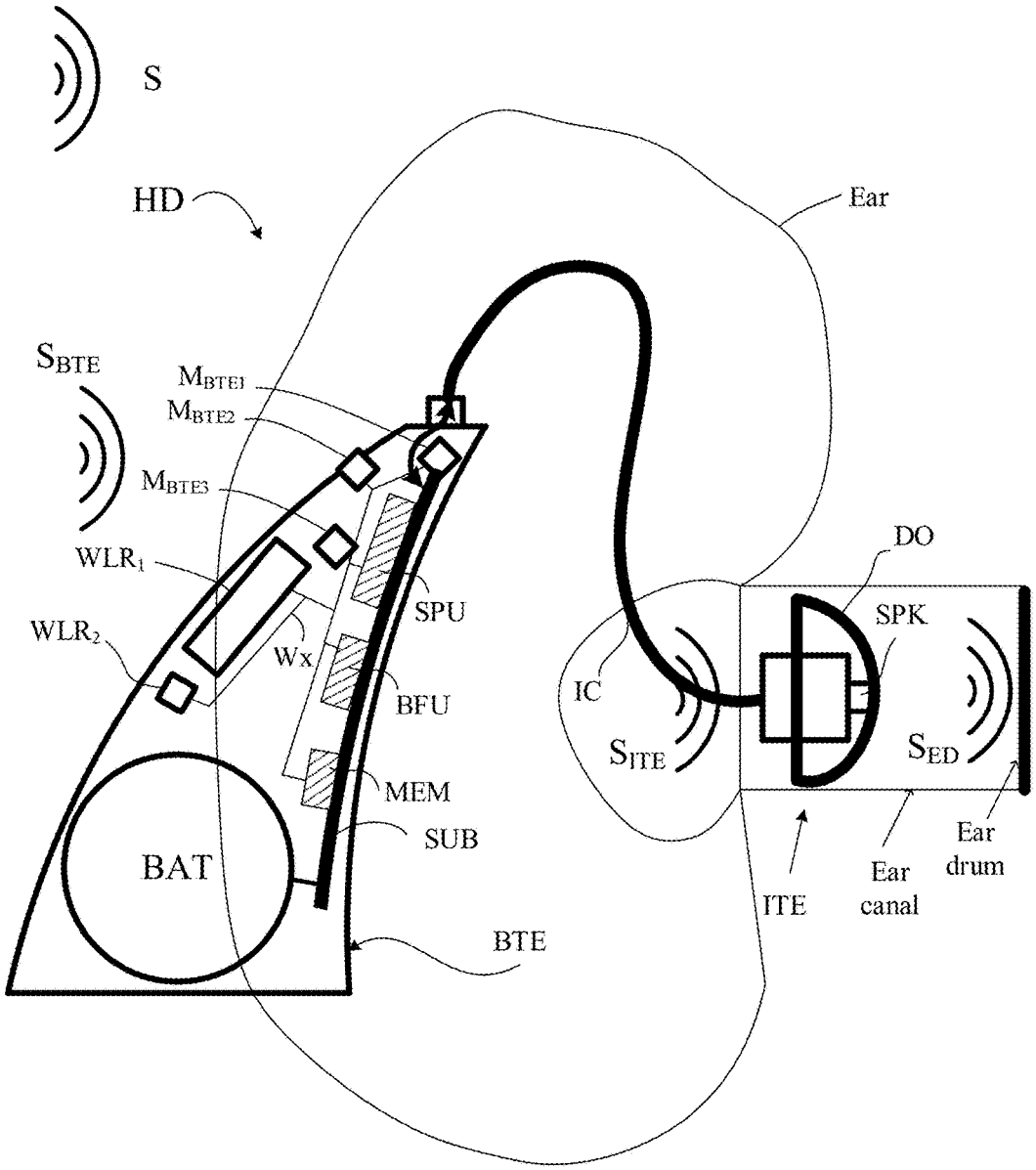
FIG. 8B shows a second embodiment of a hearing aid according to the present disclosure comprising a BTE-part located behind an ear of a user and an ITE part located in an ear canal of the user.

FIG. 8B shows a second embodiment of a hearing aid according to the present disclosure comprising a BTE-part located behind an ear of a user and an ITE part located in an ear canal of the user. The embodiment of FIG. 8B resembles the embodiment of FIG. 8B but has no microphone in the ITE-part. Further, the BTE-part comprises three microphones (M=3). In this embodiment, the BTE-microphones ($M_{BTE1}$, $M_{BTE2}$, $M_{BTE3}$) are not located in the horizontal plane. Preferably in a triangle, where two of the microphones are located in the horizontal plane. This has the advantage that the directional pattern can be adapted not only to the directional ITE response in the horizontal plane, but the directional pattern towards the directional ITE response measured at other elevation angles can also be optimized.

The hearing aid (HD) exemplified in FIG. 8A, 8B is a portable device and further comprises a battery (BAT) for energizing electronic components of the BTE- and ITE-parts.

The hearing aid (HD) comprises a directional microphone system (beamformer filtering unit (BFU)) adapted to enhance a target acoustic source among a multitude of acoustic sources in the local environment of the user wearing the hearing aid device. In an embodiment, the directional system is adapted to detect (such as adaptively detect) from which direction a particular part of the microphone signal (e.g. a target part and/or a noise part) originates. The memory unit (MEM) comprises predefined complex, frequency dependent constants $W_1(k)'$, $W_2(k)'$ (FIG. 8A) or $W_1(k)'$, $W_2(k)'$, $W_3(k)'$ (FIG. 8B) defining an optimized (fixed) beamformer according to the present disclosure, together defining the beamformed signal Y.

The hearing aid of FIG. 8A, 8B may constitute or form part of a hearing aid and/or a binaural hearing aid system according to the present disclosure.

Figure 9:
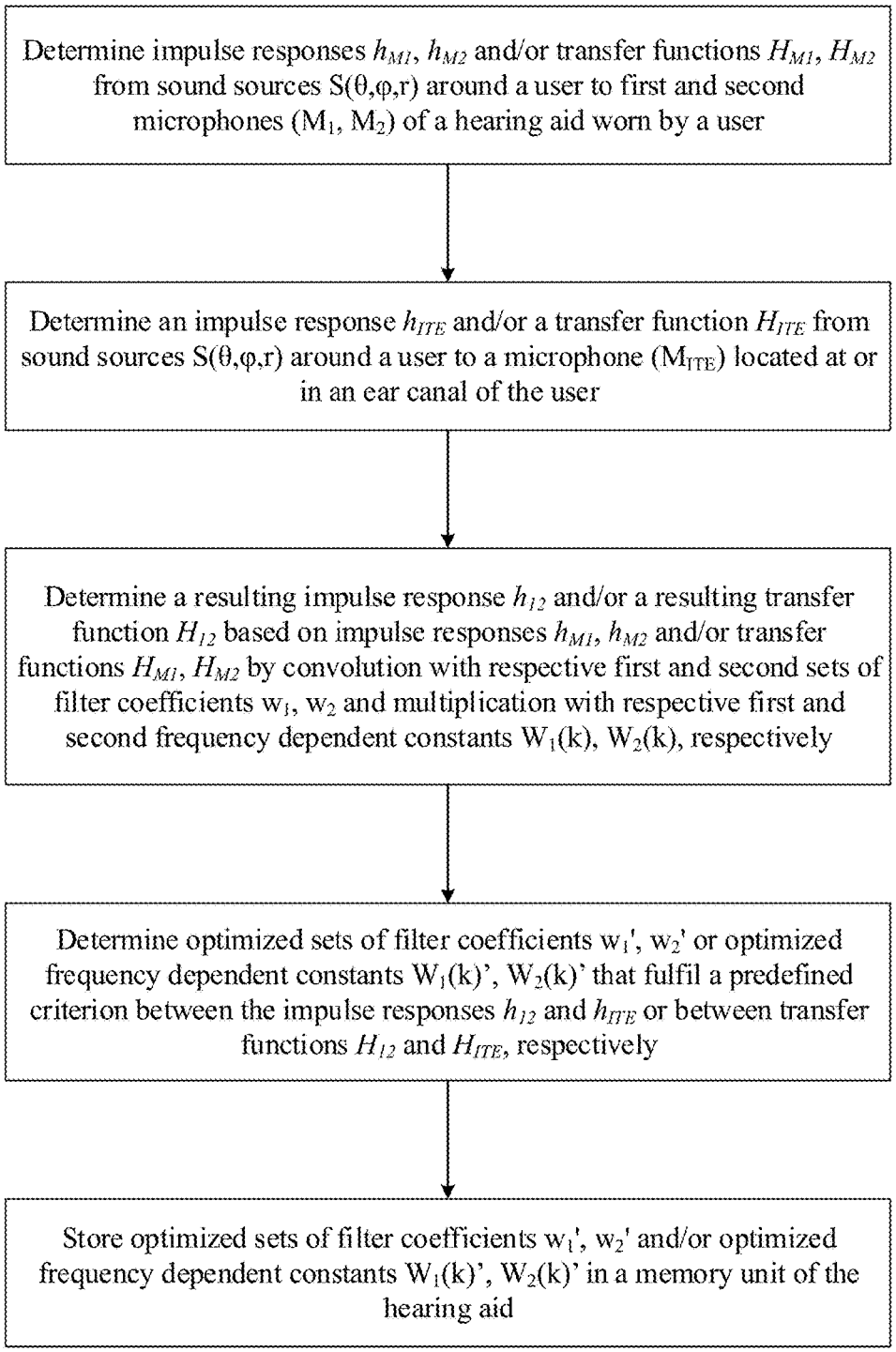
FIG. 9 shows a flow diagram for an embodiment of a method of determining optimized first and second sets of filter coefficients $w_1$ and $w_2$ and/or first and second complex, frequency dependent constants $W_1(k)$ and $W_2(k)$ of a fixed beamformer filtering unit.

FIG. 9 shows a flow diagram for an embodiment of a method of determining optimized first and second sets of filter coefficients $w_1'$ and $w_2'$ and/or optimized first and second complex, frequency dependent constants $W_1(k)'$ and $W_2(k)'$ of a fixed beamformer filtering unit.

The method aims at (e.g. in an off-line procedure, before the hearing aid is taken into normal use by a user) determining optimized first and second sets of filter coefficients $w_1'$ and $w_2'$ and/or optimized first and second complex, frequency dependent constants $W_1(k)'$ and $W_2(k)'$ of a fixed beamformer filtering unit (BFU, cf. e.g. FIG. 5A, 5B, 6A, 6B) providing a beamformed signal. The a beamformed signal Y reflects a resulting beam pattern of the beamformer filtering unit (BFU), and is provided a) as a combination (e.g. a sum) of filtered versions or the first and second electric input signals ($IN_1$ and $IN_2$) (time domain) using first and second sets of filter coefficients $w_1'$ and $w_2'$, or b) as a weighted combination (e.g. a sum) of first and second electric input signals ($IN_1$ and $IN_2$) (frequency domain) using first and second complex, frequency dependent constants $W_1(k)'$ and $W_2(k)'$. $IN_1$ and $IN_2$ are electric input signals provided by first and second microphones ($M_{BTE1}$, $M_{BTE2}$), respectively, to the beamformer filtering unit (BFU). The first and second microphones may e.g. form part of a BTE-part of a hearing aid, the BTE-part being adapted for being located at or behind an ear of a user.

In an embodiment, the method provides fading between an adaptively determined beam pattern and the pinna omni-pattern (optimized fixed beam pattern) according to the present disclosure, such fading being e.g. described in our co-pending European patent application titled "A hearing device comprising a beamformer filtering unit" referred to above.

The method may e.g. be carried out during manufacture of the hearing aid or during fitting of the hearing aid to the needs of a particular user.

The method comprises

S1. Determine impulse responses $h_{M1}$, $h_{M2}$ and/or transfer functions $H_{M1}$, $H_{M2}$ from sound sources S(θ, φ, r) around a user to first and second microphones ($M_1$, $M_2$) of a hearing aid worn by a user (or a model of the user), or determine said impulse responses $h_{M1}$, $h_{M2}$ and/or transfer functions $H_{M1}$, $H_{M2}$ using an acoustic simulation model.

S2. Determine an impulse response $h_{ITE}$ and/or a transfer function $H_{ITE}$ from sound sources S(θ, φ, r) around a user to a microphone ($M_{ITE}$) located at or in an ear canal of the user (or a model of the user), or determine said impulse response $h_{ITE}$ and/or a transfer function $H_{ITE}$ using an acoustic simulation model.

S3. Determine a resulting impulse response $h_{12}$ and/or a resulting transfer function $H_{12}$ based on impulse responses $h_{M1}$, $h_{M2}$ and/or transfer functions $H_{M1}$, $H_{M2}$ by convolution with respective first and second sets of filter coefficients $w_1$, $w_2$ and multiplication with respective first and second frequency dependent constants $W_1(k)$, $W_2(k)$, respectively.

S4. Determine optimized sets of filter coefficients $w_1'$, $w_2'$ or optimized frequency dependent constants $W_1(k)'$, $W_2(k)'$ that fulfil a predefined criterion between the impulse responses $h_{12}$ and $h_{ITE}$ or between transfer functions $H_{12}$ and $H_{ITE}$, respectively.

S5. Store optimized sets of filter coefficients $w_1'$, $w_2'$ and/or optimized frequency dependent constants $W_1(k)'$, $W_2(k)'$ in a memory unit of the hearing aid.

(θ, φ, r) denote spatial coordinates of the sound source S.

The resulting impulse response $h_{12}$ may be defined by the following expression $$h_{12}(\theta,\varphi,r)=w_1*h_{M1}(\theta,\varphi,r)+w_2*h_{M2}(\theta,\varphi,r)$$

where * denotes the convolution operator.

The resulting transfer function $H_{12}$ may be defined by the following expression $$H_{12}(\theta,\varphi,r,k)=W_1(k)\cdot H_{M1}(\theta,\varphi,r,k)+W_2(k)\cdot H_{M2}(\theta,\varphi,r,k)$$

where · denotes multiplication.

In an embodiment, the predefined criterion comprises a minimization of a difference or distance measure between the resulting transfer function $H_{12}(\theta, \varphi, r, k)$ and the transfer function $H_{ITE}(\theta, \varphi, r, k)$ of the microphone located close to or in the ear canal. Correspondingly, the predefined criterion may comprise a minimization of a difference or distance measure between the resulting impulse response $h_{12}(\theta, \varphi, r, k)$ and the impulse response $H_{ITE}(\theta, \varphi, r, k)$ of the microphone located close to or in the ear canal.

The specific predefined criterion may e.g. comprise one or more of the criteria mentioned in previous parts of the present disclosure.

It is intended that the structural features of the devices described above, either in the detailed description and/or in the claims, may be combined with steps of the method, when appropriately substituted by a corresponding process.

The concept of the present disclosure is illustrated by examples where the microphones of the hearing aid are located in a BTE-part and a scheme for amending a directional response of the BTE-microphones to reflect a response of a microphone located at or in the ear canal more closely. Other (non-ideal) locations of the microphones than behind the ear may be envisage as well (e.g. in a front facing part of pinna, e.g. in concha). The method can also be used to optimize towards directional patterns, which listens more towards the front direction compared to the natural directivity of a pinna. In that case another target directional pattern should be included than $h_{ITE}(\theta, k)$, or the desired directivity index or the desired front back ratio should be increased compared to the directivity of the natural pinna. This could e.g. be relevant for people who have lost most of their audibility at the high frequencies. In that case, directional cues could be introduced at lower frequencies. The method can also include a modification of the impulse response $h_{ITE}$ and/or a transfer function $H_{ITE}$ of a microphone ($M_{ITE}$) located at or in an ear canal of the user in one or more frequency bands, e.g. to remove a possible bias towards a rear direction (over a front direction), i.e. e.g. in case gain of the ITE microphone response is larger in a rear direction than in a front direction.

Alternatively, the modification could be made in order to further bias the gain of the ITE microphone response towards the front direction (target signal).

Figure 10:
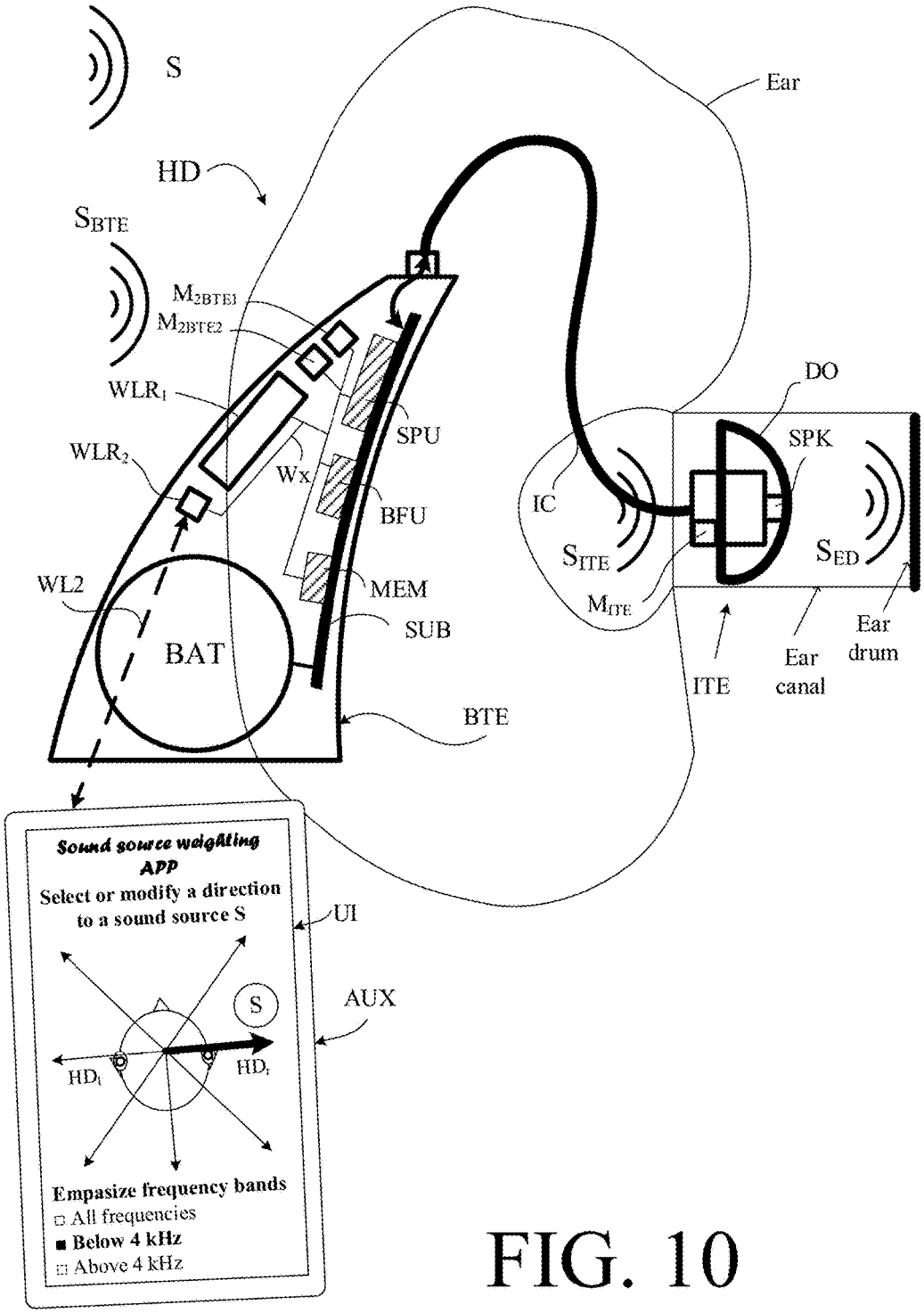
FIG. 10 illustrates a hearing aid comprising a user interface implemented in an auxiliary device according to the present disclosure.

FIG. 10 illustrates a hearing aid (HD) as shown in FIG. 8A comprising a user interface (UI) implemented in an auxiliary device (AD) according to the present disclosure.

The hearing aid (HD) according to the present disclosure (e.g. as shown in FIG. 8A or FIG. 8B) may comprise a user interface (UI) implemented in an auxiliary device (AUX), e.g. a remote control, e.g. implemented as an APP in a smartphone or other portable (or stationary) electronic device. In the embodiment of FIG. 10, the screen of the user interface (UI) illustrates a Sound source weighting APP. The user interface (UI) is adapted to allow a user (as shown in the central part of the screen, here wearing left and right hearing aids, $HD_l$, $HD_r$) to emphasize a direction to and/or a frequency range of interest of a current sound source S in the environment of the user, thereby determining or influencing a weighting function ρ(θ, φ, r, k) for a current sound source of interest to the user. A direction to the present sound source (S) of interest may be selected from the user interface, e.g. by dragging the sound source symbol to a currently relevant direction relative to the user. The currently selected target direction is to the right side of the user, as indicated by the bold arrow to the sound source S. The lower part of the screen allows the user to emphasize a particular current frequency range of interest (Emphasize frequency bands) A choice between 'All frequencies' (e.g. 0-10 kHz), 'Below 4 kHz', and 'Above 4 kHz' is offered the user by ticking the relevant box to the left of each option (other relevant ranges may be selectable according to the practical application). In the illustrated example, the frequency range below 4 kHz has been chosen (as indicated by the black filled tick box and the bold face highlight of the text 'Below 4 kHz'). A low frequency range may be emphasized in certain situations, e.g. in a telephone mode of operation or during transportation in a car, etc. A choice of 'All frequencies' may be implemented as a default. In an embodiment, the user interface is adapted to allow a user to qualify (e.g. accept or reject or modify) an adaptively determined weighting function for emphasizing a direction to or a frequency range of interest of a current sound source in the environment of the user and/or a specific frequency range of interest.

The auxiliary device and the hearing aid are adapted to allow communication of data representative of the currently selected direction (if deviating from a predetermined direction (already stored in the hearing aid)) to the hearing aid via a, e.g. wireless, communication link (cf. dashed arrow WL2 in FIG. 10). The communication link WL2 may e.g. be based on far field communication, e.g. Bluetooth or Bluetooth Low Energy (or similar technology), implemented by appropriate antenna and transceiver circuitry in the hearing aid (HD) and the auxiliary device (AUX), indicated by transceiver unit $WLR_2$ in the hearing aid.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

The invention claimed is:

1. A hearing aid comprising a part, termed a BTE-part, adapted for being located in an operational position at of behind an ear of a user, the BTE-part comprising a multitude M of microphones ($M_{BTEi}$, i=1, . . . , M) for converting an input sound to respective electric input signals ($IN_i$, i=1, . . . , M), the multitude of microphones of the BTE-part, when located behind the ear of the user being characterized by transfer functions $H_{BTEi}(\theta, \varphi, r, k)$, i=1, . . . , M, representative of propagation of sound from sound sources S located at (θ, φ, r) around the hearing aid to the respective microphones ($M_{BTEi}$, i=1, . . . , M), when the BTE-part is located at its operational position, (θ, φ, r) representing spatial coordinates and k is a frequency index, a memory unit comprising complex, frequency dependent constants $W_i(k)'$, i=1, . . . , M, a beamformer filtering unit for providing a beamformed signal Y as a weighted combination of said multitude of electric input signals using said complex, frequency dependent constants $W_i(k)'$, i=1, . . . , M: $Y(k)=W_1(k)'\cdot IN_1+\ldots+W_M(k)'\cdot IN_M$, and wherein said frequency dependent constants $W_i(k)'$, i=1, . . . , M, are determined to provide a resulting transfer function $$H_{pinna}(\theta,\varphi,r,k)=\Sigma_{i=1}^{M}W_i(k)\cdot H_{BTEi}(\theta,\varphi,r,k),$$

so that a difference between the resulting transfer function $H_{pinna}(\theta, \varphi, r, k)$ and a transfer function $H_{ITE}(\theta, \varphi, r, k)$ of a microphone located close to or in the ear canal fulfils a predefined criterion, wherein said predefined criterion determines $W_i(k)'$, i=1, . . . , M, according to one of the following expressions:

$$\underset{W_i'(k),\forall i}{\operatorname{argmin}}\left(\sum_{\theta,\varphi,r}\rho(\theta,\varphi,r,k)|\log|H_{pinna}(\theta,\varphi,r,k)|-\log|H_{ITE}(\theta,\varphi,r,k)||\right),$$

$$\underset{W_i'(k),\forall i}{\operatorname{argmin}}\left(\sum_{\theta,\varphi,r}\rho(\theta,\varphi,r,k)(\log|H_{pinna}(\theta,\varphi,r,k)|-\log|H_{ITE}(\theta,\varphi,r,k)|)^2\right),$$

$$\underset{W_i'(k),\forall i}{\operatorname{argmin}}\left(\sum_{\theta,\varphi,r}\rho(\theta,\varphi,r,k)||H_{pinna}(\theta,\varphi,r,k)|-|H_{ITE}(\theta,\varphi,r,k)||\right),$$

$$\underset{W_i'(k),\forall i}{\operatorname{argmin}}\left(\sum_{\theta,\varphi,r}\rho(\theta,\varphi,r,k)||H_{pinna}(\theta,\varphi,r,k)|-|H_{ITE}(\theta,\varphi,r,k)||^2\right),$$

$$\underset{W_i'(k),\forall i}{\operatorname{argmin}}\left(\sum_{\theta,\varphi,r}\rho(\theta,\varphi,r,k)(|H_{pinna}(\theta,\varphi,r,k)|^2-|H_{ITE}(\theta,\varphi,r,k)|^2)^2\right),$$

$$\underset{W_i'(k),\forall i}{\operatorname{argmin}}\left(\sum_{\theta,\varphi,r}\rho(\theta,\varphi,r,k)||H_{pinna}(\theta,\varphi,r,k)|^2-|H_{ITE}(\theta,\varphi,r,k)|^2|\right),$$

where ρ(θ, φ, r, k) is a weighting function, and i=1, . . . , M is a microphone index.

2. A hearing aid according to claim 1 wherein said predefined criterion comprises a minimization of a difference or distance measure between the resulting transfer function $H_{pinna}(\theta, \varphi, r, k)$ and the transfer function $H_{ITE}(\theta, \varphi, r, k)$ of the microphone located close to or in the ear canal.

3. A hearing aid according to claim 1 comprising a hearing instrument, a headset, an earphone, an ear protection device or a combination thereof.

4. A method of determining a multitude M of complex, frequency dependent constants $W_i(k)'$, i=1, . . . , M, representing an optimized fixed beam pattern of a fixed beamformer filtering unit providing a beamformed signal as a weighted combination of said multitude of electric input signals $IN_i$, i=1, . . . , M, to the beamformer filtering unit, where $IN_i$ are electric input signals provided by a multitude of microphones ($M_{BTEi}$, i=1, . . . , M) of a hearing aid, a BTE-part being adapted for being located at or behind an ear of a user, the method comprising determining respective transfer functions $H_{BTEi}(\theta, \varphi, r, k)$ and $H_{ITE}(\theta, \varphi, r, k)$ from sound sources S located at spatial coordinates (θ, φ, r) around the hearing aid to the multitude of microphones ($M_{ETEi}$, i=1, . . . , M), and to a microphone located close to or in the ear canal (ITE), (θ, φ, r) representing spatial coordinates and k being a frequency index, and determining said frequency dependent constants $W_i(k)'$, i=1, . . . , M, to provide a resulting transfer function $$H_{pinna}(\theta,\varphi,r,k)=\Sigma_{i=1}^{M}W_i(k)\cdot H_{BTEi}(\theta,\varphi,r,k),$$

so that a difference between the resulting transfer function $H_{pinna}(\theta, \varphi, r, k)$ and the transfer function $H_{ITE}(\theta, \varphi, r, k)$ of a microphone located close to or in the ear canal fulfils a predefined criterion, wherein said predefined criterion comprises determining $W_i(k)'$, i=1, . . . , M, according to one of the following expressions:

$$\underset{W_i(k),\forall i}{\operatorname{argmin}}\left(\sum_{\theta,\varphi,r}\rho(\theta,\varphi,r,k)\left|\log|H_{pinna}(\theta,\varphi,r,k)|-\log|H_{ITE}(\theta,\varphi,r,k)|\right|\right),$$

$$\underset{W_i(k),\forall i}{\operatorname{argmin}}\left(\sum_{\theta,\varphi,r}\rho(\theta,\varphi,r,k)(\log|H_{pinna}(\theta,\varphi,r,k)|-\log|H_{ITE}(\theta,\varphi,r,k)|)^2\right),$$

$$\underset{W_i(k),\forall i}{\operatorname{argmin}}\left(\sum_{\theta,\varphi,r}\rho(\theta,\varphi,r,k)\left||H_{pinna}(\theta,\varphi,r,k)|-|H_{ITE}(\theta,\varphi,r,k)|\right|\right),$$

$$\underset{W_i(k),\forall i}{\operatorname{argmin}}\left(\sum_{\theta,\varphi,r}\rho(\theta,\varphi,r,k)\left||H_{pinna}(\theta,\varphi,r,k)|-|H_{ITE}(\theta,\varphi,r,k)|\right|^2\right),$$

$$\underset{W_i(k),\forall i}{\operatorname{argmin}}\left(\sum_{\theta,\varphi,r}\rho(\theta,\varphi,r,k)(|H_{pinna}(\theta,\varphi,r,k)|^2-|H_{ITE}(\theta,\varphi,r,k)|^2)^2\right),$$

$$\underset{W_i(k),\forall i}{\operatorname{argmin}}\left(\sum_{\theta,\varphi,r}\rho(\theta,\varphi,r,k)\left||H_{pinna}(\theta,\varphi,r,k)|^2-|H_{ITE}(\theta,\varphi,r,k)|^2\right|\right),$$

where $\rho(\theta, \varphi, r, k)$ is a weighting function, and i=1, . . . , M s a microphone index.

5. A method according to claim 4 wherein said predefined criterion comprises a minimization of a difference or distance measure between the resulting transfer function $H_{pinna}(\theta, \varphi, r, k)$ and the transfer function $H_{ITE}(\theta, \varphi, r, k)$ of the microphone located close to or in the ear canal.

6. A method according to claim 4 wherein said predefined criterion comprises determining $W_i(k)$, i=1, . . . , M, to minimize a cost function comprising the resulting transfer function $H_{pinna}(\theta, \varphi, r, k)$ and the transfer function $H_{ITE}(\theta, \varphi, r, k)$ of a microphone located close to or in the ear canal (ITE).

7. A method of determining a multitude M of complex, frequency dependent constants $W_i(k)'$, i=1, . . . , M, representing an optimized fixed beam pattern of a fixed beamformer filtering unit providing a beamformed signal as a weighted combination of said multitude of electric input signals $IN_i$, i=1, . . . , M, to the beamformer filtering unit, where $IN_i$ are electric input signals provided by a multitude of microphones ($M_{BTEi}$, i=1, . . . , M) of a hearing aid, a BTE-part being adapted for being located at or behind an ear of a user, the method comprising determining respective transfer functions $H_{BTEi}(\theta, \varphi, r, k)$ and $H_{ITE}(\theta, \varphi, r, k)$ from sound sources S located at spatial coordinates $(\theta, \varphi, r)$ around the hearing aid to the multitude of microphones ($M_{BTEi}$, i=1, . . . , M), and to a microphone located close to or in the ear canal, $(\theta, \varphi, r)$ representing spatial coordinates and k being a frequency index, and determining said frequency dependent constants $W_i(k)'$, i=1, . . . , M, to provide a resulting transfer function $$H_{pinna}(\theta,\varphi,r,k)=\Sigma_{i=1}^{M}W_i(k)\cdot H_{BTEi}(\theta,\varphi,r,k),$$

so that a difference between the resulting transfer function $H_{pinna}(\theta, \varphi, r, k)$ and the transfer function $H_{ITE}(\theta, \varphi, r, k)$ of a microphone located close to or in the ear canal fulfils a predefined criterion wherein M=2 further comprising generating first and second fixed beamformers BF1 and BF2 as different weighted combinations of the first and second electric input signals $IN_1$ and $IN_2$, respectively, each beamformer being defined by frequency dependent complex weighting parameter sets $(W_{11}(k), W_{21}(k))$ and $(W_{12}(k), W_{22}(k))$, respectively, so that $$BF1(k)=W_{11}(k)\cdot IN_1+W_{21}(k)\cdot IN_2,$$

$$BF2(k)=W_{12}(k)\cdot IN_1+W_{22}(k)\cdot IN_2, \text{ and}$$

generating a beamformed signal Y as a combination of said first and second fixed beamformers BF1 and BF2 according to the following expression $$Y(k)=BF1(k)-\beta(k)\cdot BF2(k),$$

where $\beta(k)$ is a frequency dependent parameter controlling the shape of the directional beam pattern of the beamformer filtering unit.

8. A method according to claim 7 wherein said first and second fixed beamformers BF1 and BF2 are a delay and sum beamformer O and a delay and subtract beamformer C, respectively.

9. A method of determining a multitude M of complex, frequency dependent constants $W_i(k)'$, i=1, . . . , M, representing an optimized fixed beam pattern of a fixed beamformer filtering unit providing a beamformed signal as a weighted combination of said multitude of electric input signals $IN_i$, i=1, . . . , M, to the beamformer filtering unit, where IN; are electric input signals provided by a multitude of microphones ($M_{BTEi}$, i=1, . . . , M) of a hearing aid, a BTE-part being adapted for being located at or behind an ear of a user, the method comprising determining respective transfer functions $H_{BTEi}(\theta, \varphi, r, k)$ and $H_{ITE}(\theta, \varphi, r, k)$ from sound sources S located at spatial coordinates $(\theta, \varphi, r)$ around the hearing aid to the multitude of microphones ($M_{BTEi}$, i=1, . . . , M), and to a microphone located close to or in the ear canal, $(\theta, \varphi, r)$ representing spatial coordinates and k being a frequency index, and determining said frequency dependent constants $W_i(k)'$, i=1, . . . , M, to provide a resulting transfer function $$H_{pinna}(\theta,\varphi,r,k)=\Sigma_{i=1}^{M}W_i(k)\cdot H_{BTEi}(\theta,\varphi,r,k),$$

so that a difference between the resulting transfer function $H_{pinna}(\theta, \varphi, r, k)$ and the transfer function $H_{ITE}(\theta, \varphi, r, k)$ of a microphone located close to or in the ear canal fulfils a predefined criterion, wherein said predefined criterion comprises determining $W_1(k)'$ and $W_2(k)'$ by minimizing an expression for a distance measure between the beamformed signal $Y(\theta, \varphi, r, k)$ and the transfer function $H_{ITE}(\theta, \varphi, r, k)$ of a microphone located at or in the ear canal with respect to the parameter $\beta(k)$, where $\beta(k)$ is a frequency dependent parameter controlling the shape of the directional beam pattern of the beamformer filtering unit.

10. A method according to claim 9, wherein said predefined criterion comprises determining $W_1(k)'$ and $W_2(k)'$ according to one of the following expressions:

$$\underset{W_i(k),\forall i}{\operatorname{argmin}}\left(\sum_{\theta,\varphi,r}\rho(\theta,\varphi,r,k)\left|\log|H_{pinna}(\theta,\varphi,r,k)|-\log|H_{ITE}(\theta,\varphi,r,k)|\right|\right),$$

$$\underset{W_i(k),\forall i}{\operatorname{argmin}}\left(\sum_{\theta,\varphi,r}\rho(\theta,\varphi,r,k)(\log|H_{pinna}(\theta,\varphi,r,k)|-\log|H_{ITE}(\theta,\varphi,r,k)|)^2\right),$$

$$\underset{W_i(k),\forall i}{\operatorname{argmin}}\left(\sum_{\theta,\varphi,r}\rho(\theta,\varphi,r,k)\left||H_{pinna}(\theta,\varphi,r,k)|-|H_{ITE}(\theta,\varphi,r,k)|\right|\right),$$

$$\underset{W_i(k),\forall i}{\operatorname{argmin}}\left(\sum_{\theta,\varphi,r}\rho(\theta,\varphi,r,k)\left||H_{pinna}(\theta,\varphi,r,k)|-|H_{ITE}(\theta,\varphi,r,k)|\right|^2\right),$$

-continued $$\underset{W_i(k),\forall i}{\operatorname{argmin}}\left(\sum_{\theta,\varphi,r}\rho(\theta,\varphi,r,k)(|H_{pinna}(\theta,\varphi,r,k)|^2-|H_{ITE}(\theta,\varphi,r,k)|^2)^2\right),$$

$$\underset{W_i(k),\forall i}{\operatorname{argmin}}\left(\sum_{\theta,\varphi,r}\rho(\theta,\varphi,r,k)||H_{pinna}(\theta,\varphi,r,k)|^2-|H_{ITE}(\theta,\varphi,r,k)|^2|\right),$$

where $\rho(\theta, \varphi, r, k)$ is a weighting function.

11. A method according to claim 4 wherein the weighting function $\rho(\theta, \varphi, r, k)$ is configured to compensate for the fact that some directions and/or frequency ranges are more significant than other directions, and/or to compensate for a non-uniform data collection.

12. A method according to claim 4 wherein the weighting function $\rho(\theta, \varphi, r, k)$ is adaptively determined.

13. A method according to claim 4, wherein the impulse response ($h_{ITE}$)/transfer function ($H_{ITE}$) of the microphone ($M_{ITE}$) located at or in the ear canal is/are normalized with respect to the target direction (e.g. $H_{ITE}(\theta_{target})=1$).

14. A method of determining a multitude M of complex, frequency dependent constants $W_i(k)'$, i=1, . . . , M representing an optimized fixed beam pattern of a fixed beamformer filtering unit providing a beamformed signal as a weighted combination of said multitude of electric input signals $IN_i$, i=1, . . . , M to the beamformer filtering unit, where IN; are electric input signals provided by a multitude of microphones ($M_{BTEi}$, i=1, . . . , M) of a hearing aid, a BTE-part being adapted for being located at or behind an ear of a user, the method comprising determining respective transfer functions $H_{BTEi}(\theta, \varphi, r, k)$ and $H_{ITE}(\theta, \varphi, r, k)$ from sound sources S located at spatial coordinates $(\theta, \varphi, r)$ around the hearing aid to the multitude of microphones ($M_{BTEi}$, i=1, . . . , M), and to a microphone located close to or in the ear canal, $(\theta, \varphi, r)$ representing spatial coordinates and k being a frequency index, and determining: said frequency dependent constants $W_i(k)'$, i=1, . . . , M, to provide a resulting transfer function $$H_{pinna}(\theta,\varphi,r,k)=\Sigma_{i=1}^{M}W_i(k)\cdot H_{BTEi}(\theta,\varphi,r,k),$$

so that a difference between the resulting transfer function $H_{pinna}(\theta, \varphi, r, k)$ and the transfer function $H_{ITE}(\theta, \varphi, r, k)$ of a microphone located close to or in the ear canal fulfils a predefined criterion, wherein the predefined criterion comprises minimizing a directional response of the beamformed signal to have a similar front-back ratio compared to the front-back ratio, respectively, of a microphone located at or in the ear canal.

15. A method of determining a multitude M of complex, frequency dependent constants $W_i(k)'$, i=1, . . . , M, representing an optimized fixed beam pattern of a fixed beamformer filtering unit providing a beamformed signal as a weighted combination of said multitude of electric input signals $IN_i$, i=1, . . . , M, to the beamformer filtering unit, where $IN_i$ are electric input signals provided by a multitude of microphones ($M_{BTEi}$, i=1, . . . , M) of a hearing aid, a BTE-part being adapted for being located at or behind an ear of a user, the method comprising determining respective transfer functions $H_{BTEi}(\theta, \varphi, r, k)$ and $H_{ITE}(\theta, \varphi, r, k)$ from sound sources S located at spatial coordinates $(\theta, \varphi, r)$ around the hearing aid to the multitude of microphones ($M_{BTEi}$, i=1, . . . , M), and to a microphone located close to or in the ear canal, $(\theta, \varphi, r)$ representing spatial coordinates and k being a frequency index, and determining said frequency dependent constants $W_i(k)'$, i=1, . . . , M, to provide a resulting transfer function $$H_{pinna}(\theta,\varphi,r,k)=\Sigma_{i=1}^{M}W_i(k)\cdot H_{BTEi}(\theta,\varphi,r,k),$$

so that a difference between the resulting transfer function $H_{pinna}(\theta, \varphi, r, k)$ and the transfer function $H_{ITE}(\theta, \varphi, r, k)$ of a microphone located close to or in the ear canal fulfils a predefined criterion, wherein the predefined criterion comprises determining $W_1(k)$ and $W_2(k)$ according to one of the following expressions:

$$\underset{\beta(k)}{\operatorname{argmin}}(|DI_{pinna}(k)-DI_{ITE}(k)|),$$

$$\underset{\beta(k)}{\operatorname{argmin}}(|FBR_{pinna}(k)-FBR_{ITE}(k)|),$$

where the directivity index DI is given as the ratio between the response of the target direction $\theta_0$ and the response of all other directions, and the front-back ratio FBR is the ratio between the responses of the front half plane and the responses of the back half plane:

$$DI(k)=\log_{10}\frac{|R(\theta_0,k)|^2}{\int|R(\theta,k)|^2\rho(\theta,k)d\theta}$$

$$FBR(k)=\log_{10}\frac{\int_{front}|R(\theta,k)|^2\rho_{front}(\theta,k)d\theta}{\int_{back}|R(\theta,k)|^2\rho_{back}(\theta,k)d\theta}$$

where $\rho_x(\theta, k)$ is a direction-dependent weighting function (x=front, back) either compensating for a non-uniform dataset or in order to take into account that some directions are more significant than other directions.

16. A method according to claim 4 wherein at least one of the transfer functions $H_{BTE1}(\theta, \varphi, r, k)$, $H_{BTE2}(\theta, \varphi, r, k)$, and $H_{ITE}(\theta, \varphi, r, k)$ is determined in less than three dimensions of space, e.g. in two dimensions, such as in a polar plane, and/or only in one dimension, such as in a polar plane, e.g. at one radial distance, e.g. $r_0$=3-5 m, or a distance $r_\infty$ corresponding to the acoustic far field.

17. A method according to claim 4 wherein the transfer function $H_{ITE}(\theta, \varphi, r, k)$ of the microphone located close to or in the ear canal, before being used in said predefined criterion, is modified in one or more frequency bands.

18. A method according to claim 4 comprising fading between an adaptively determined beam pattern and the optimized fixed beam pattern.

19. A method according to claim 4 wherein $\beta(k)$ is adapted so that null directions or attenuation above a certain threshold, e.g. attenuation larger than 10 dB, on the ipsilateral side are avoided to mimic the effect of a natural pinna that does not cancel out sounds completely from any direction.

20. A data processing system comprising a processor and program code means for causing the processor to perform the method of claim 4.

* * * * *